United States Patent [19]

Halbert

[11] Patent Number: 4,744,238

[45] Date of Patent: May 17, 1988

[54] PNEUMATIC RIVET SETTING TOOL

[75] Inventor: Eric H. Halbert, Cincinnati, Ohio

[73] Assignee: Senco Products, Inc., Cincinnati, Ohio

[21] Appl. No.: 881,340

[22] Filed: Jul. 2, 1986

[51] Int. Cl.[4] ..... B21J 15/34

[52] U.S. Cl. ..... 72/391; 72/453.16; 29/243.53; 227/107; 91/511; 91/513; 91/189 R

[58] Field of Search ..... 72/391, 453.16, 453.17, 72/114, 453.19; 29/243.53; 227/107, 112, 139; 91/43, 189 R, 511, 513, 517

[56] References Cited

U.S. PATENT DOCUMENTS

| | | | |
|---|---|---|---|
| 3,367,166 | 2/1968 | Newton et al. | 72/391 |
| 3,733,882 | 5/1973 | Klein | 72/391 |
| 3,777,540 | 12/1973 | Siebol et al. | 72/391 |
| 3,886,783 | 6/1975 | Hirsh | 72/391 |
| 3,974,913 | 8/1976 | Hirsch | 206/344 |
| 3,996,784 | 12/1976 | Champoux et al. | 72/391 |
| 4,027,520 | 6/1977 | Klein | 72/391 |
| 4,131,009 | 12/1978 | Hara et al. | 72/391 |
| 4,178,669 | 12/1979 | Hara et al. | 29/412 |
| 4,630,460 | 12/1986 | Mauer | 72/391 |

*Primary Examiner*—David Jones
*Attorney, Agent, or Firm*—Frost & Jacobs

[57] ABSTRACT

A pneumatically actuated tool for setting blind rivets of the type having a body, a head and breakaway pull mandrel. The tool comprises a body having a double-acting cylinder therein, a handle attached to the body, a guide body affixed to the body beneath the cylinder, a pull track in the guide body for the rivets and a bore in the body connecting the cylinder and the pull track, the cylinder, the bore, and the pull track being coaxial. The tool is provided with a rivet pickup and pull mechanism comprising a lower load piston having a downwardly depending tubular assembly slidable within the body bore and pull track and terminating in a nose piece, and an upper pull piston having a downwardly depending tubular assembly telescopicly and shiftably located within the lower load piston tubular assembly and terminating in a chuck provided with mandrel-engaging jaws. The tool has a magazine connected to the guide body and containing a strip of rivets. An automatic rivet feed mechanism is provided comprising a shiftable feeder shoe and pawl for advancing the forwardmost rivet of the strip into the guide body pull track, a ratchet for preventing the strip from shifting away from the guide body pull track, and means to hold and center the forwardmost rivet in the guide body pull track. The tool is further provided with pneumatic sequencing controls which provide full cycle-through control, such that the tool, once triggered, will perform the full cycle, and the next cycle cannot be started until the trigger is released at the end of the previous cycle.

17 Claims, 18 Drawing Sheets

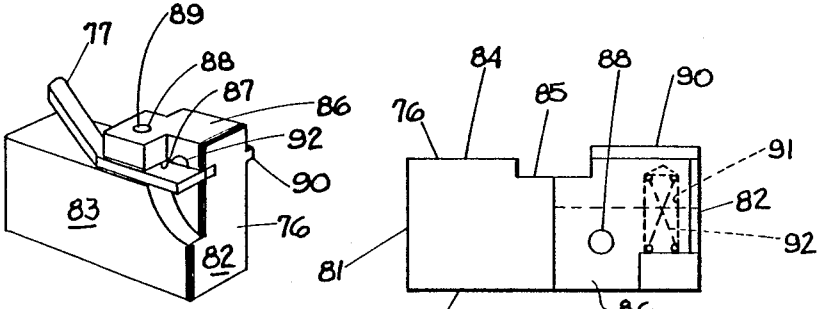
FIG. 15
FIG. 18
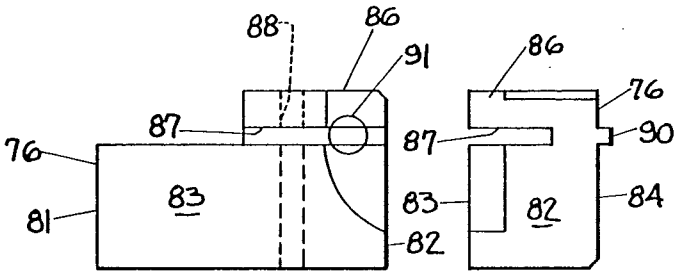
FIG. 20
FIG. 21
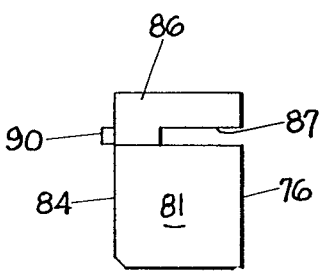
FIG. 19
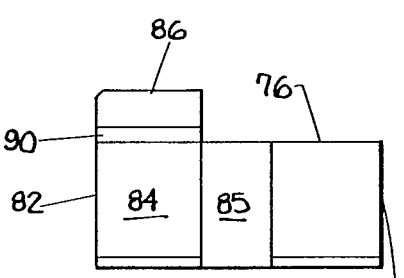
FIG. 22

PNEUMATIC RIVET SETTING TOOL

TECHNICAL FIELD

The present invention relates to a pneumatic rivet setting tool, and more particularly to such a tool having a rivet pickup and pull mechanism and a rivet feed mechanism of simplified construction, a magazine utilizing a strip of rivets, and sequencing controls providing cycle-through operation utilizing pneumatic logic.

BACKGROUND ART

Prior art workers have devised numerous types of blind rivet setting tools. Such tools are normally manually actuated, pneumatically actuated or hydraulically actuated.

Most such rivet setting tools are of the type wherein loose rivets are hand-inserted into the pulling tool, one-by-one. On assembly lines, such feeding is slow, awkward and leads to dropped rivets which must be picked up.

Prior art workers have also devised automatic, pneumatic rivet setting tools provided with a magazine and utilizing a strip of rivets. It is to this type of rivet setting tool that the present invention is directed. Examples of such rivet setting tools are set forth in U.S. Pat. Nos. 3,886,783; 3,974,913; 4,131,009 and 4,178,669. While these devices perform well, they are generally slow in operation and complex in construction.

The present invention provides a pneumatic rivet setting tool of simple construction, characterized by cycle-through operation utilizing pneumatic logic. Once the trigger is actuated, the tool will complete a cycle regardless of the position of the trigger. Another cycle cannot be started unless the trigger is first released. While the tool can be used as a single-shot, muzzle-fed tool, it is provided with a magazine for the receipt of strips of rivets and an automatic rivet feed mechanism. Finally, the tool is provided with a collection means for the rivet mandrels after they are pulled and broken.

DISCLOSURE OF THE INVENTION

According to the invention there is provided a pneumatically actuated rivet setting tool. The tool comprises a body, a handle and a magazine for receipt of strips of rivets. The body of the tool is provided with an air cylinder and a guide body. The guide body provides a pull track for the rivets and is operatively connected to the magazine. The body also houses an automatic rivet feed mechanism comprising a shiftable feeder shoe and pawl for advancing the forwardmost rivet of a strip into the guide body track, a ratchet for preventing the rivet strip from shifting away from the guide body track, and means to hold and center the forwardmost rivet in the guide body track.

The tool has a rivet pickup and pull mechanism. This mechanism comprises a lower load piston and an upper pull piston, both located in the air cylinder, which is of the double acting type. The lower load piston carries a tubular assembly made up of a load sleeve and a load post. The free end of the load post carries the tool nose piece. The upper pull piston carries a tubular structure, located within the lower load piston tubular structure, and comprising a pull sleeve, the free end of which terminates in a chuck. The chuck carries a pair of mandrel engaging jaws, together with means to spring bias the jaws to their closed positions.

The tool is further provided with pneumatic sequencing controls which provide full cycle-through control, such that the tool, once triggered, always goes through the full cycle before it stops, and the next cycle cannot be started unless the trigger is released at the end of the previous cycle.

BRIEF DESCRIPTION OF THE DRAWINGS

FIG. 15 is a perspective view of the feeder shoe—feeder pawl assembly of the present invention.

FIG. 18 is a plan view of the feeder shoe.

FIG. 19 is an end elevational view of the feeder shoe, as viewed from the left of FIG. 18.

FIG. 20 is a side elevational view of the feeder shoe as viewed from the bottom of FIG. 18.

FIG. 21 is an end elevational view of the feeder shoe as viewed from the right of FIG. 18.

FIG. 22 is a side elevational view of the feeder shoe as viewed from the top of FIG. 18.

DETAILED DESCRIPTION OF THE INVENTION

Figure 1:
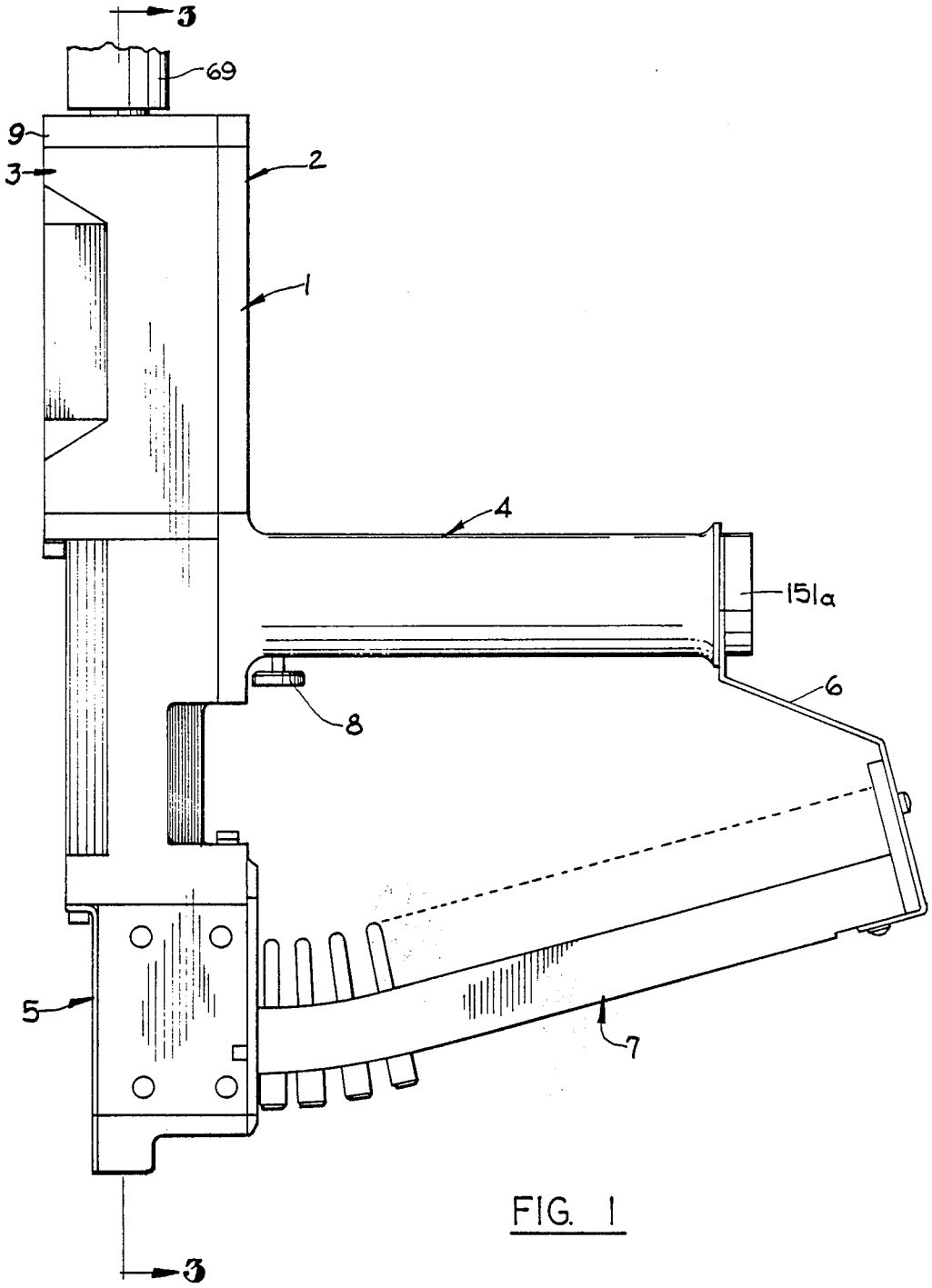
FIG. 1 is a side elevational view of the pneumatic rivet setting tool of the present invention.

Reference is first made to FIG. 1 wherein the pneumatic rivet tool of the present invention is generally indicated at 1. The tool comprises a body portion generally indicated at 2. A part 3 of the body portion constitutes an air cylinder, as will be evident hereinafter. The body 2 is provided with a handle portion, generally indicated at 4. At its lower end, the body portion 2 terminates in a guide body, generally indicated at 5. The handle portion 4 supports a bracket 6. A magazine, generally indicated at 7 is affixed at one end by bracket 6 and at the other end to guide body 5. The handle portion 2, near that end which is affixed to body portion 2, carries a manual trigger 8 by which the tool is actuated. The opposite end of handle portion 4 has a port (151*a*) which is suitably connected to a source of air under pressure by a hose or the like.

Figure 2:
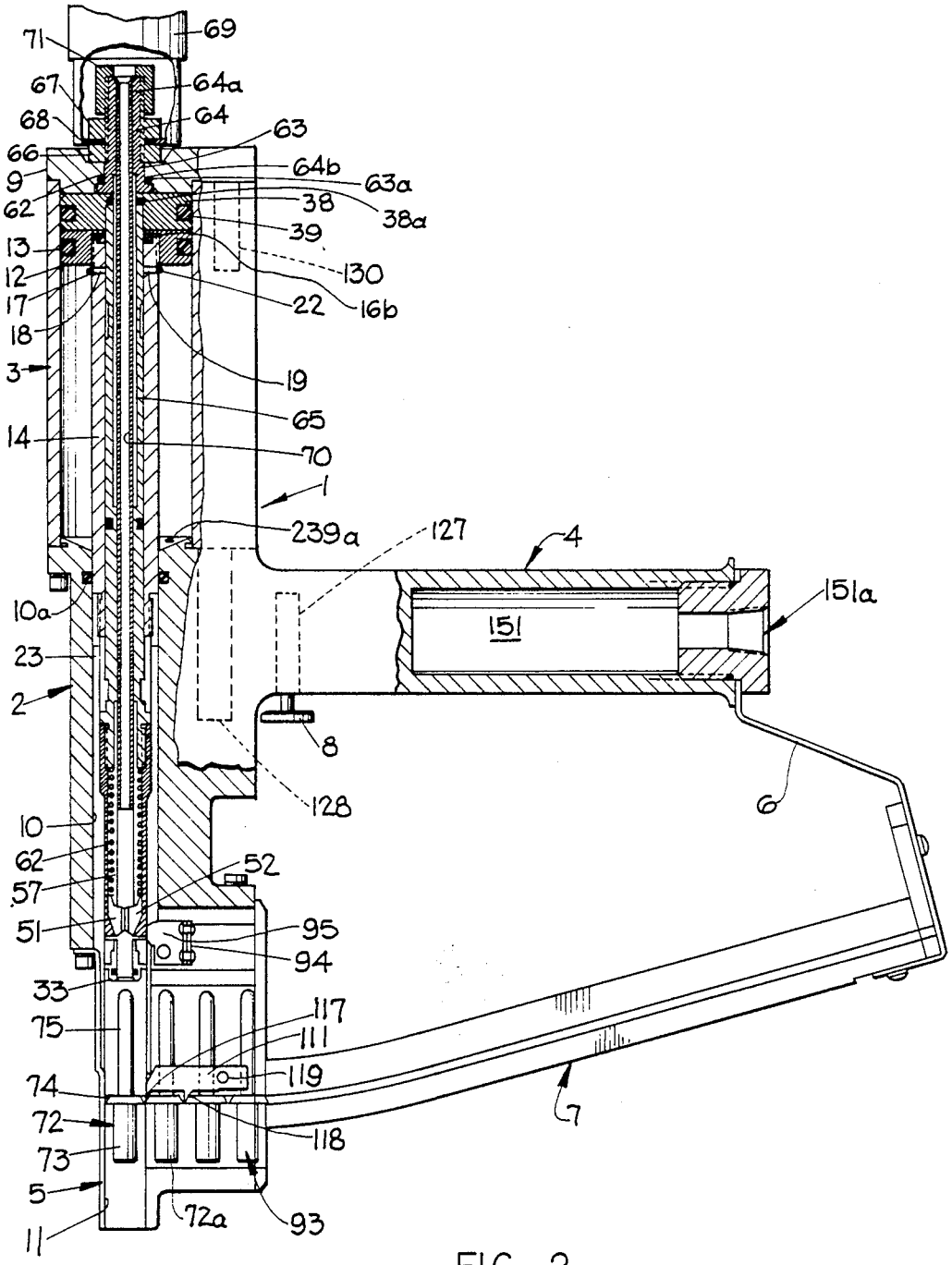
FIG. 2 is a side elevational view similar to FIG. 1, but partly in cross section, showing the rivet pickup and pull mechanism in its topmost position.
Figure 3:
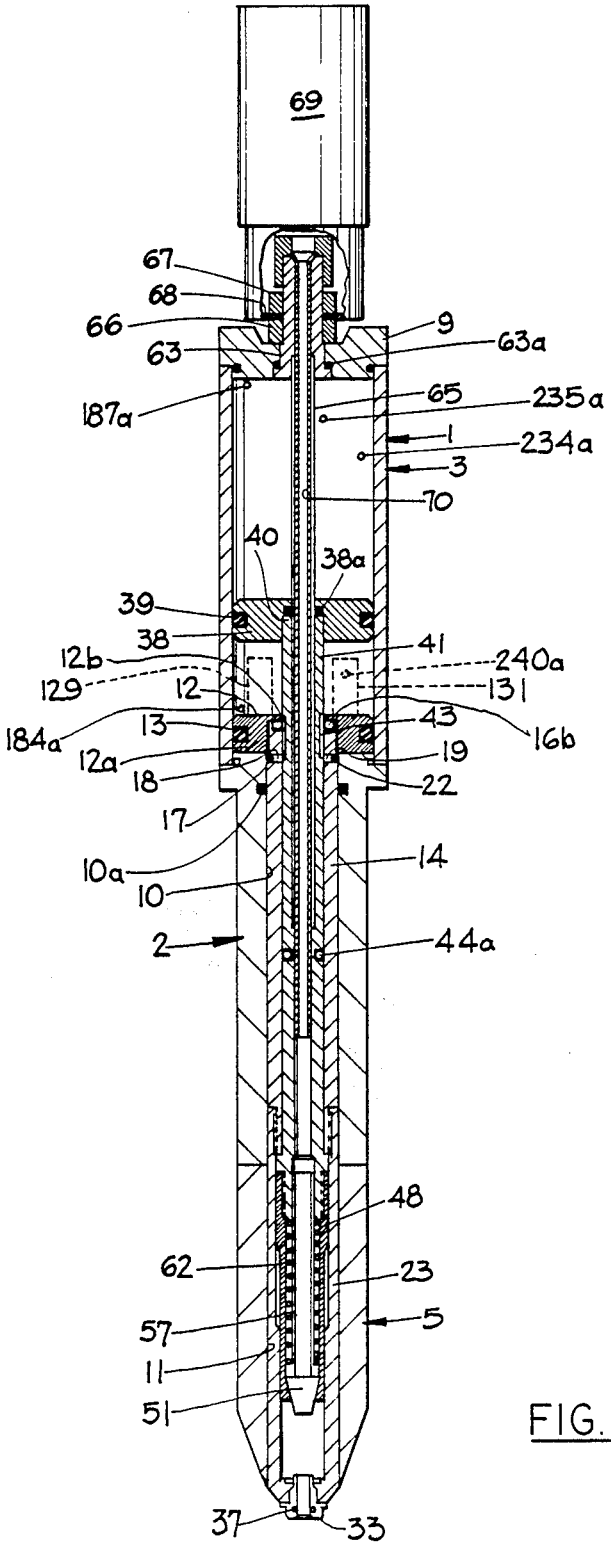
FIG. 3 is a cross sectional view taken along section line 3—3 of FIG. 1, showing the rivet pickup and pull mechanism in its position at the completion of the rivet pull.

Reference is now made to FIGS. 2 and 3, wherein like parts have been given like index numerals. The cylinder 3 is closed at its upper end by a cap 9. At its lower end, the cylinder is closed by the body 2 of the tool except for a bore 10 which extends vertically through the body (as viewed in FIGS. 2 and 3) from the cylinder 3 to guide body 5. The bore 10 comprises an extension of the track 11 defined by guide body 5.

Cylinder 3 contains a first lower load piston 12. The lower load piston 12 carries an O-ring 13 so as to be in sealing engagement with the sidewall of cylinder 3. The lower load piston has an axial bore therethrough having a first threaded portion 12*a* and a second unthreaded portion 12*b* of lesser diameter (see FIG. 3).

Figure 4:
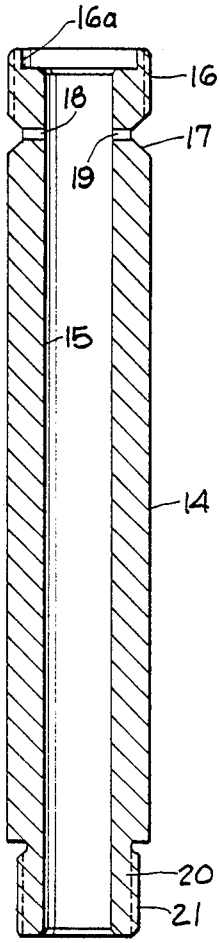
FIG. 4 is a longitudinal cross sectional view of the load sleeve of the present invention.

Lower load piston 12 carries an elongated tubular load sleeve 14. The load sleeve 14 is best shown in FIG. 4. The load sleeve 14 has an outside diameter such that it has a sliding fit in the bore 10 of body 2, which is sealed by an O-ring 10*a*. The load sleeve 14 has an axial bore 15. At its upper end the load sleeve 14 is externally threaded as at 16, with a counterbore 16*a* (FIG. 4) for an O-ring seal 16*b* (FIGS. 2 and 3). Just below the threaded portion 16 there is an annular groove 17. A pair of diametrically opposed transverse passages 18 and 19 communicate between annular groove 17 and axial bore 15. At its lower end, the load sleeve 14 has a portion 20 of lesser diameter, which portion is externally threaded, as at 21. As can be seen in FIGS. 2 and 3, the upper threaded portion 16 of load sleeve 14 is threadedly engaged in the threaded bore 12*a* of lower load piston 12, with the annular groove 17 and bores 18 and 19 lying just beneath the lower load piston 12. As can further been seen in FIGS. 2 and 3, the annular groove 17 of load sleeve 14 carries an O-ring 22 which serves as a check valve, the purpose of which will be described hereinafter.

Figure 5:
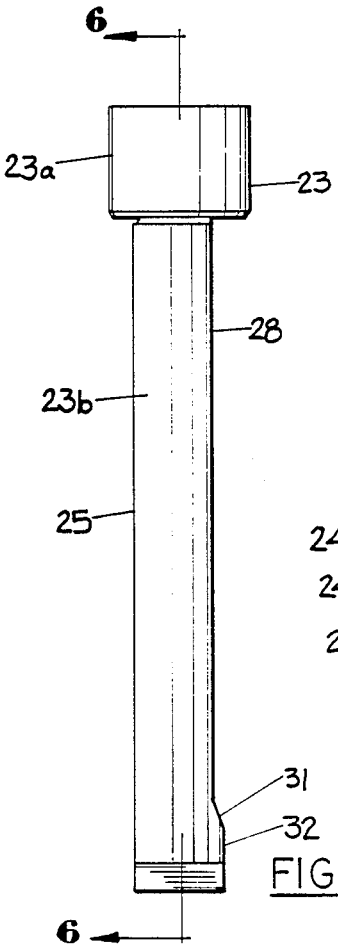
FIG. 5 is a side elevational view of the load post of the present invention.
Figure 7:
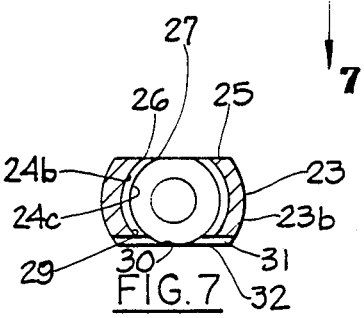
FIG. 7 is a cross sectional view taken along section line 7—7 of FIG. 6.
Figure 6:
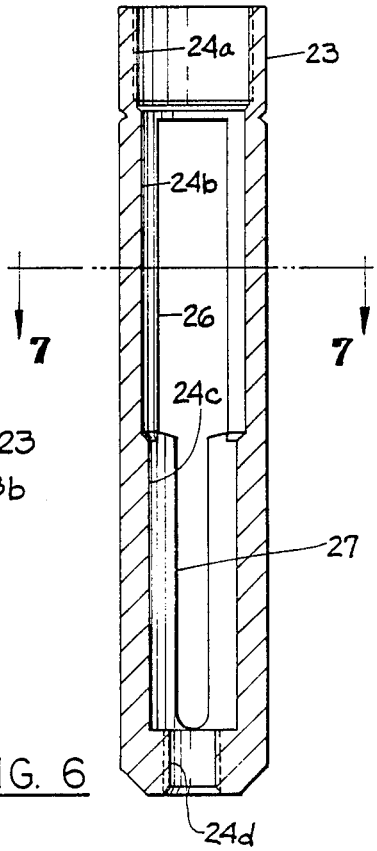
FIG. 6 is a cross sectional view taken along section line 6—6 of FIG. 5.

The load sleeve 14 is affixed to and carries a load post 23. The load post 23 is shown in FIGS. 5, 6 and 7. As can most clearly be ascertained from FIG. 6, the load post 23 comprises an elongated cylindrical member having an external diameter identical to that of the load sleeve 14, so as to have a sliding fit in the bore 10 of body 2 and the track 11 of guide body 5. The load post has an axial bore which comprises a first threaded portion 24*a*, a second portion 24*b* of slightly lesser diameter, a third portion 24*c* of further reduced diameter, and a fourth and final portion 24*d* of yet further reduced diameter and being internally threaded.

As can perhaps best be seen in FIGS. 5 and 7, the uppermost portion 23*a* of load post 23 is cylindrical. The same is true of the remainder of the load post 23*b*, except that it has a longitudinally extending flat 25 formed thereon. The flat 25 intersects bore portions 24*b* and 24*c*. forming openings 26 and 27 therein. The opposite side of load post 23 has an elongated longitudinal flat 28 formed therein, the flat 28 intersects bore portions 24*b* and 24*c* forming openings 29 and 30 therein. The flat 28 terminates in an outwardly and downwardly sloping flat 31, which in turn terminates in another vertical flat 32 (as viewed in FIG. 5). The flats 31 and 32 serve as cam surfaces, as will be apparent hereinafter.

Figure 8:
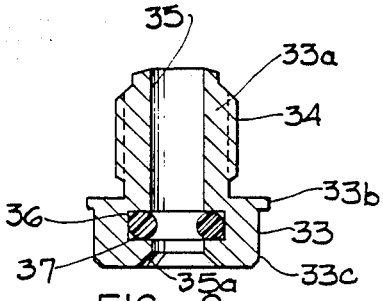
FIG. 8 is a cross sectional view of the nose piece of the present invention.
Figure 9:
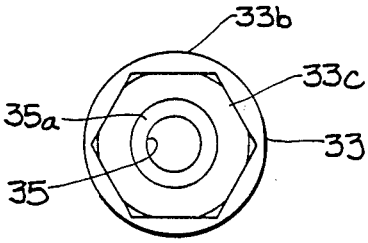
FIG. 9 is a bottom view of the nose piece.

To complete the structure of the lower load piston 12, the lowermost end of load post 23 carries a nose piece 33. The nose piece 33 is illustrated in FIGS. 8 and 9. The nose piece 33 has a first cylindrical body portion 33*a*, externally threaded as at 34. The body portion 33*a* surmounts a circular flange portion 33*b*, which in turn surmounts a hexagonal body portion 33*c*. A cylindrical bore 35 extends through body portions 33*a* through 33*c*, and is slightly outwardly flared as at 35*a*. Nose pieces with bores to fit various mandrel diameters of rivets of various sizes can be provided. The nose piece 33 is provided with an annular groove 36 in the body portion 33*c*, which carries a friction device such as an O-ring 37, the purpose of which will be apparent hereinafter. As can most clearly be seen in FIG. 3, and with further reference to FIG. 6, the externally threaded cylindrical body portion 33*a* of nose piece 33 is threadedly engaged in the threaded bore portion 24*d* of load post 23 with the flange portion 33*b* of the nose piece 33 abutting the lowermost end of load post 23.

The cylinder 3 carries a second upper pull piston 38, similar to load piston 12. Upper pull piston 38 has an annular notch for receipt of an O-ring 39, such that the upper pull piston 38 is in sealing engagement with the inner wall of cylinder 3. The upper pull piston has an axial bore 40, the lower portion of which is threaded. A counterbore above the threaded portion provides room for an O-ring 38*a*, which seals the opening between the bore 40 and the outside of mandrel tube 65 to be described hereinafter.

Figure 10:
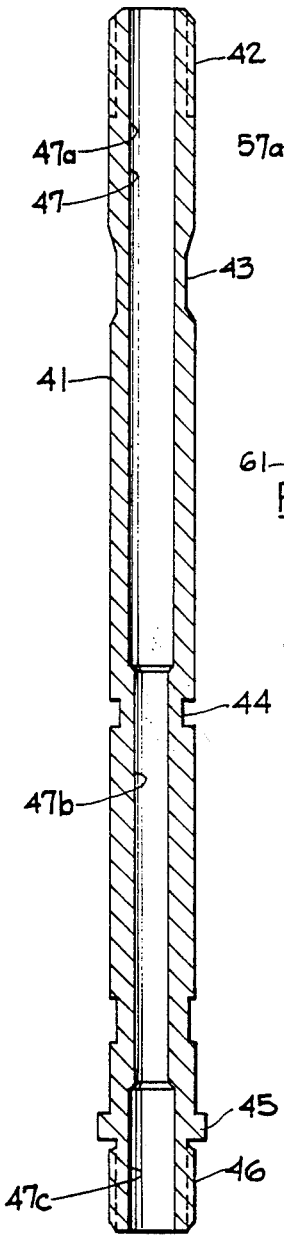
FIG. 10 is a longitudinal cross sectional view of the pull sleeve of the present invention.

The upper pull piston 38 carries an elongated tubular pull sleeve 41. The pull sleeve 41 is shown in FIG. 10. The pull sleeve 41 has an outside diameter such that it is slidable within the bore 15 of load sleeve 14 (see FIG. 4). This diameter contacts the inside surface of O-ring 16*b* to seal the opening between the pull sleeve 41 and the load sleeve 14. The upper end of pull sleeve 41 is externally threaded as at 42 so that it can be threadedly engaged in the threaded portion of upper pull piston bore 40. Below threaded portion 42, pull sleeve 41 is provided with a shallow annular groove 43, the purpose of which will be apparent hereinafter. Yet further down its length, pull sleeve 41 is provided with an annular groove 44 for receipt of an O-ring 44*a*, to form a seal with the interior surface of load sleeve 14. Near its lower end, pull sleeve 41 has an annular flange 45 which serves as a stop means, as will be apparent hereinafter. That portion of pull sleeve 41 below annular flange 45 is externally threaded as at 46.

The pull sleeve 41 has an axial bore 47 made up of a first portion 47*a*, a second portion 47*b* of slightly lesser diameter, and a third portion 47*c* of a diameter substantially the same as portion 47*a*.

Figure 11:
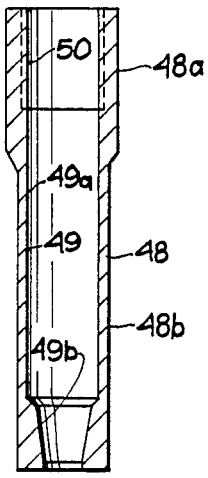
FIG. 11 is a longitudinal cross sectional view of the chuck of the present invention.

Pull sleeve 41 carries on its lowermost end a chuck 48. The chuck 48 is shown in FIG. 11. The chuck 48 is an elongated tubular member having a first body portion 48*a* having an outside diameter substantially equal to the outside diameter of stop flange 45 of pull sleeve 41. The chuck 48 has a second body portion 48*b* of lesser outside diameter. As is evident from FIGS. 2 and 3, the chuck 48 is adapted to be received within load post 23. As a consequence, the outside diameter of chuck portion 48*a* is such that it has a sliding fit in bore portion 24*b* of load post 23. Similarly, the outside diameter of chuck portion 48*b* is such as to have a sliding fit in bore portion 24*c* of load post 23 (see FIG. 6).

The chuck 48 has an axial bore 49, having a first portion 49*a* of uniform diameter throughout, and a second portion 49*b* which tapers downwardly and inwardly. The uppermost part of bore portion 49*a* is internally threaded as at 50 and is adapted to be threadedly engaged with the externally threaded portion 46 of pull sleeve 41 with the upper end of chuck 48 abutting the lower surface of pull sleeve stop flange 45.

Figure 12:
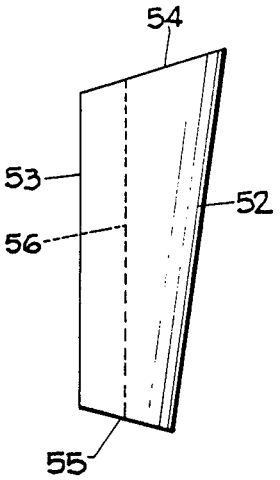
FIG. 12 is a side elevational view of a jaw of the present invention.
Figure 13:
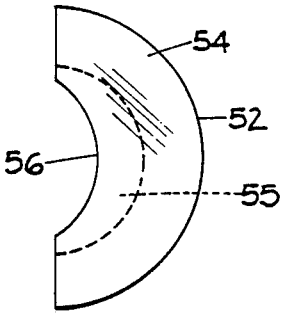
FIG. 13 is a plan view of the jaw of FIG. 12.

A pair of tapered jaws are loosely mounted in the conical bore portion 49*b* of chuck 48. The jaws are shown at 51 and 52 in FIG. 2. The jaws 51 and 52 are identical and jaw 52 is further illustrated in FIGS. 12 and 13. The jaw 52 has a nearly half conical, tapered body with a flat forward surface 53, an upwardly and outwardly sloping upper surface 54 and a downwardly and outwardly sloping lower surface 55. The flat forward surface 53 has a vertical serrated groove 56 formed therein, as viewed in FIGS. 12 and 13.

Figure 14:
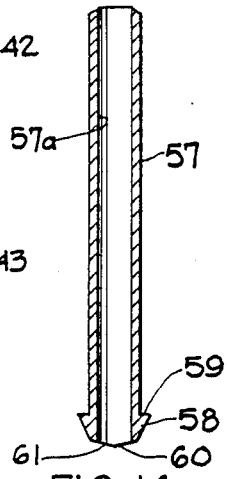
FIG. 14 is a longitudinal cross sectional view of the plunger of the, present invention.

The chuck 48 also carries within it a plunger 57. The plunger 57 is most clearly seen in FIG. 14. The plunger comprises an elongated tubular member having an enlarged conical head 58 formed at its lowermost end. The head 58 defines an annular shoulder 59. The head 58 has downwardly and inwardly sloping surfaces 60 and 61. The surface 60 is adapted to abut the sloping upper surface 54 of jaw 52. The surface 61 is adapted to abut the corresponding upper surface of jaw 51. The outside diameter of plunger 57 is such as to be slidingly received in the bore portion 47*c* of pull sleeve 41. As can be clearly seen in FIGS. 2 and 3, the plunger 57 is surrounded by a compression spring 62. The upper end of compression spring 62 abuts the lowermost end of pull sleeve 41. The lower end of compression spring 62 abuts the shoulder 59 of plunger 57. The compression spring 62 serves to urge the plunger against the jaws, thus biasing the jaws to their closed or gripping positions.

Returning to FIG. 2, the cap 9 of cylinder 3 has an axial bore 62 adapted to receive and engage an elongated tubular member 63. The tubular member 63 has an outside diameter such that it fits through the axial bore 62 of cap 9. The upper end of this diameter is threaded. The lower end of the tubular member 63 is enlarged into a collar which seats against the inside of cap 9. An O-ring 63*a* in a groove on the outside of tubular member 63 seals the opening between it and cap 9. The tubular member 63 has an axial bore 64 having an upper bore portion 64*a* and a lower bore portion 64*b* of larger diameter. An outer mandrel tube 65 is affixed permanently within the bore portion 64*b* and extends downwardly therefrom. The mandrel tube 65 has an internal diameter such that the mandrel portions of the rivets can be slidably received therein. The mandrel tube 65 has an exterior diameter such as to be slidably receivable in the bore 40 of pull piston 38 and also the bore portion 47*a* of pull sleeve 41. An O-ring 38*a* seals the opening between the bore 40 of pull piston 38 and the exterior diameter of mandrel tube 65, as indicated above.

A nut 66 threadedly engages on the member 63 to hold it in cap 9. A second nut 67 is also threadedly mounted on member 63 to engage a flange portion 68 of a container 69 (see FIGS. 1,2 and 3) for receipt of and collection of the broken mandrel pieces. When rivets having mandrels of lesser diameter are used the mandrels tend to jam in the larger parts of the passage, particularly in the bore 47 of pull sleeve 41. An inner mandrel tube 70 may be mounted in mandrel tube 65 to reduce this tendency. The upper end of inner mandrel tube 70 is flared and held in place on member 63 by an additional nut 71. The inner mandrel tube extends downwardly through bore 47 of pull sleeve 41 and the internal bore 57*a* of plunger 57.

Ports are provided in the walls of cylinder 3 and body 2 of the tool 1 at 187*a*, 235*a*, 234*a*, 240*a*, 184*a* and 239*a* for connection to the pneumatic control system to be described hereinafter.

That part of the tool 1 thus far described constitutes the rivet pickup and pull mechanism of the tool by which the rivets are set. The operation of the rivet pickup and pull mechanism will be described hereinafter. Next to be described will be the feed mechanism by which the forwardmost rivet in the magazine is located in the track 11 of the guide body.

An exemplary rivet of the type contemplated for the tool 1 is generally indicated in FIG. 2 at 72. The rivet 72 is a substantially conventional plastic pull rivet having a body portion 73, a head 74 and a mandrel 75. During the rivet setting operation, the rivet is inserted in coaxial holes in elements to be joined. With the head 74 pressed against the workpieces, the mandrel 75 is pulled in a direction away from the body 73. This causes the body to buckle behind the elements to be joined to clinch the rivet. At the same time, an enlarged and serrated part of the mandrel locks it in the rivet. A continued pull on the mandrel breaks it at a groove and the broken part of the mandrel is disposed of.

The rivets are preferably joined together one-behind-the other, to form a strip of rivets. The manner of their joinder does not constitute a limitation on the present invention. In the manufacturing process, the heads 74 of the rivets may constitute integral one-piece parts from rivet-to-rivet, readily severable by a push force. The heads of adjacent rivets may be joined together by integral breakable plastic joining members. In yet another alternative the heads may be joined together by a strip of tape or the like.

The strip of rivets is advanced to locate the forwardmost rivet of the strip in the guide body track by a feeder shoe and pawl assembly. The feeder shoe and pawl assembly is shown in FIG. 15 wherein the feeder shoe is shown at 76 and the feeder pawl is shown at 77.

Figure 16:
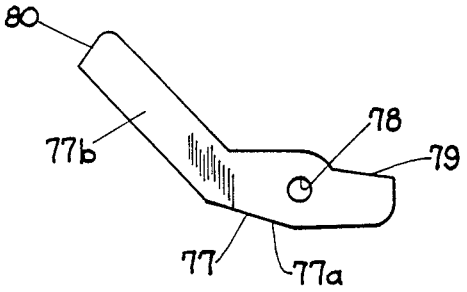
FIG. 16 is a plan view of the feeder pawl.
Figure 17:
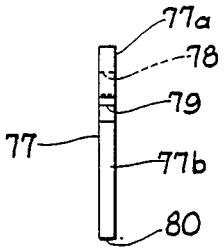
FIG. 17 is an end elevation of the feeder pawl.

The feeder pawl is illustrated in FIGS. 16 and 17. The feeder pawl comprises a planar member having a first body portion 77*a* and a second body portion 77*b*, the body portions 77*a* and 77*b* being angularly related to each other, as shown. The first body portion 77*a* has a perforation 78 therethrough for receipt of a pivot pin. The first body portion also has a rectilinear abutment surface 79, the purpose of which will be apparent hereinafter. The second body portion 77*b* of feeder pawl 77 terminates in an abutment surface 80. The purpose of abutment surface 80 will also be apparent hereinafter.

The feeder shoe 76 is illustrated in FIGS. 18 through 22, wherein like parts have been given like index numerals. FIG. 18 is a plan view of the feeder shoe which has a forward end 81, a rearward end 82, a rectilinear side 83 and a side 84 having a slot 85 formed therein. The feeder shoe 76 has an upward extension 86 thereon. The extension is partially separated from the main body of the feeder shoe by a transverse slot 87. The transverse slot 87 is adapted to accommodate the body portion 77*a* of feeder pawl 77, as shown in FIG. 15. The upward extension and the main body portion have a vertical bore 88 formed therein. The bore 88 is adapted to receive a pivot pin 89 (see FIG. 15) which also passes through the perforation 78 of feeder pawl 77. In this way, the feeder pawl is pivotally mounted on the feeder shoe. The side 84 is provided with a flange 90 which is adapted to ride in a guideway (not shown) in the guide body. To complete the feeder shoe, a transverse bore 91 is provided. The transverse bore receives a compression spring, diagrammatically indicated in FIG. 18 at 92. The compression spring 92 contacts the abutment surface 79 on the body portion 77*a* of feeder pawl 77, maintaining feeder pawl 77 in its normal extended position, shown in FIG. 15.

Figure 23:
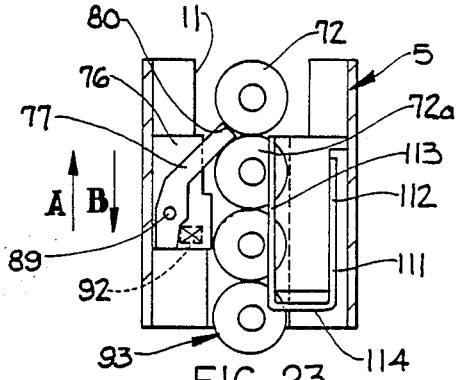
FIG. 23 is a horizontal cross sectional view of the guide body of the present invention.

Reference is made to FIG. 23 which is a simplified transverse cross sectional view of guide body 5. A strip of rivets is generally indicated at 93. The forwardmost rivet is indicated at 72, and the second rivet of the strip is indicated at 72*a*. It will be noted that the abutment surface 80 of feeder pawl 77 is engaging the head portion of the forwardmost rivet 72. The feeder shoe—feeder pawl assembly 76–77 is shown in FIG. 23 in its forwardmost position. The feeder shoe has shifted in the direction of arrow A and the abutment of feeder pawl 77 against the flange of the forwardmost rivet 72 has advanced the strip of rivets 93 until the forwardmost rivet 72 of the strip is in guide body track 11, ready to be set.

During the setting for the forwardmost rivet 72, the feeder shoe will be shifted in the direction of arrow B to its normal unextended position. During this shifting process, the feeder pawl will ride around the head of second rivet 72*a*, rotating in a counterclockwise direction as viewed in FIG. 23, about pivot pin 89 and against the action of feeder shoe spring 92. When the feeder shoe reaches its normal retracted position, the forward abutment end 80 of feeder pawl 77 will rest against the head of the second rivet 72*a*, ready to advance the row of rivets forwardly and to shift the second rivet 72*a* into the track 11, once the first rivet 72 has been set and pulled. The feeder shoe—feeder pawl assembly 76–77 is biased to its normal retracted position as will be apparent hereinafter.

Figure 26:
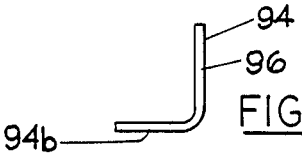
FIG. 26 is a plan view of the feeder arm.
Figure 24:
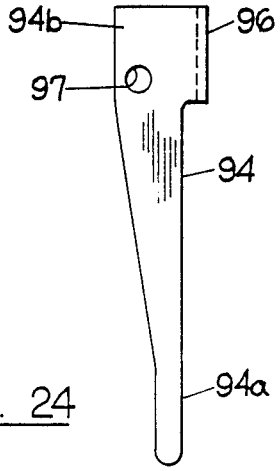
FIG. 24 is a side elevational view of the feeder arm of the present invention.
Figure 25:
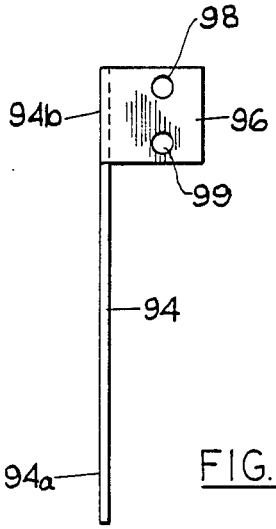
FIG. 25 is an end elevational view of the feeder arm, as viewed from the right of FIG. 24.

The feeder shoe—feeder pawl assembly 76–77 is shifted from its normal retracted position to its forward extended position and back again by a feeder arm 94 and a feeder cam 95. The feeder arm 94 is illustrated in FIGS. 24, 25 and 26 and comprises an elongated member having a lower end portion 94*a* and an upper end portion 94*b* provided with a flange 96 oriented at right angles thereto. The upper portion 94*b* of feeder arm 94 has a perforation 97 to accommodate a pivot pin (not shown). The flange 96 has a pair of perforations 98 and 99, the purpose of which will be apparent hereinafter.

Figure 27:
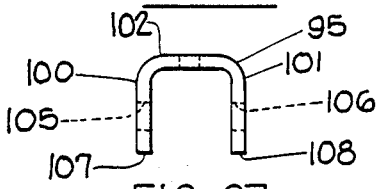
FIG. 27 is a plan view of the feeder cam of the present invention.
Figure 28:
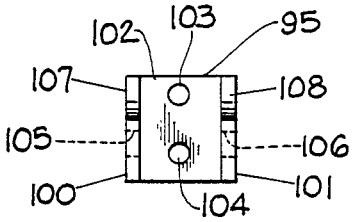
FIG. 28 is a front elevational view of the feeder cam.
Figure 29:
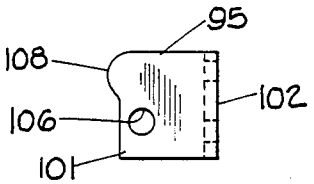
FIG. 29 is a side elevational view of the feeder cam.

The feeder cam 95 is illustrated in FIGS. 27, 28 and 29, and is a U-shaped member having a pair of legs 100 and 101 and a connecting web 102. The connecting web 102 has a pair of perforations 103 and 104 similar to the perforations 98 and 99 on feeder arm 94. The legs 100 and 101 of feeder cam 95 have coaxial perforations 105 and 106, respectively for receipt of a pivot pin (not shown). The feeder cam 95 is completed by the provision of rounded noses 107 and 108 on the free ends of legs 100 and 101, respectively.

Figure 30:
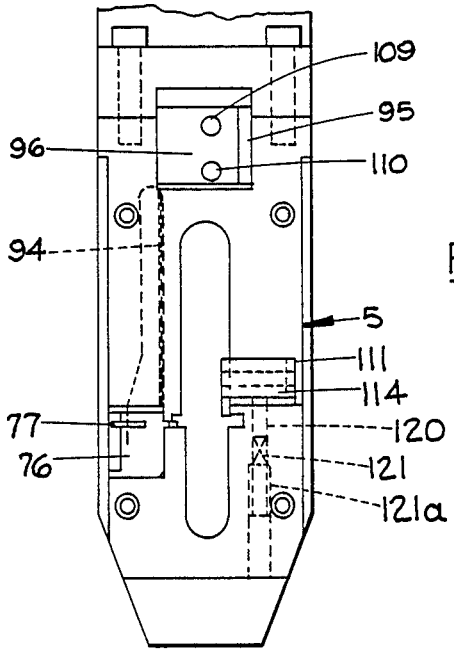
FIG. 30 is a fragmentary rear elevational view of the guide body of the present invention, with the tool magazine removed.

The feeder arm 94 is affixed to the feeder cam 95 by means of a first rivet passing through perforation 98 of feeder arm 94 and perforation 103 of feeder cam 95 and a second rivet passing through perforation 99 of feeder arm 94 and perforation 104 of feeder cam 95. These rivets are shown in FIG. 30 at 109 and 110. FIG. 30 is a rear view of guide body 5, with the magazine removed for purposes of clarity. The feeder arm—cam assembly 94–95 is shown, together with the feeder shoe—feeder pawl assembly 76–77.

The feeder arm—feeder cam assembly 94–95 is pivotally mounted within the guide body 5 by a pivot pin (not shown) passing through perforation 97 of feeder arm 94 and perforations 105 and 106 of feeder cam 95. The free end 94*a* of feeder arm 94 is located in the slot 85 of feeder shoe 76 (see FIGS. 18 and 22). The feeder arm—feeder cam assembly 94–95 is biased by spring means (not shown) to a position wherein the feeder shoe—feeder pawl assembly 76–77 is in its normal retracted position. However, the nose portions 107 and 108 of feeder cam 95 are contactable by cam surfaces 31 and 32 of load post 28, during a cycle of the tool, such that the feed end 94*a* of feeder arm 94 is shifted forwardly, shifting the feeder shoe—feeder pawl assembly 76–77 to its forwardmost, extended position shown in FIG. 23. Upon release of the feeder cam noses 107 and 108 by load post cam surfaces 31 and 32, the spring biased feeder arm—feeder cam assembly 94–95 will return the feeder shoe—feeder pawl assembly 76–77 to its normal retracted position.

Figure 31:
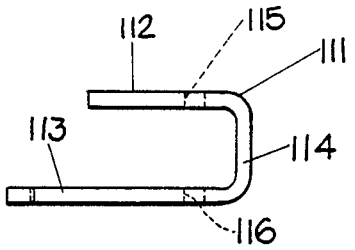
FIG. 31 is a plan view of the ratchet of the present invention.
Figure 32:
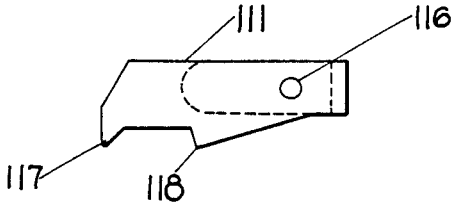
FIG. 32 is a side elevational view of the ratchet.

The feed mechanism also includes a ratchet 111. The ratchet is most clearly shown in FIGS. 31 and 32. The ratchet comprises a U-shaped member having parallel legs 112 and 113 and a joining base portion 114. The legs 112 and 113 have perforations 115 and 116, respectively, for receipt of a pivot pin (not shown). The leg 113 has a pair of ratchet teeth 117 and 118. The ratchet 111 is mounted in the guide body 5 as shown in FIGS. 23 and 30. The ratchet is pivotally mounted by a pivot pin 119 (see FIG. 2).

Ratchet 111 is spring biased to the position shown in FIG. 2 with its teeth 117 and 118 engaging the heads of the first rivet 72 and the second rivet 72*a*, respectively, of the row thereof. As a result of this, the ratchet 111 will allow the strip of rivet 93 to advance toward the guide body track 11, but it will prevent the strip of rivets 93 from shifting in the opposite direction. As is most clearly shown in FIG. 30, the ratchet is spring biased to its normal position (shown in FIG. 2) by a plunger 120 and a spring 121, held in place by a set screw 121*a*. The plunger engages the underside of the web or base portion 114 of the ratchet 111.

Figure 33:
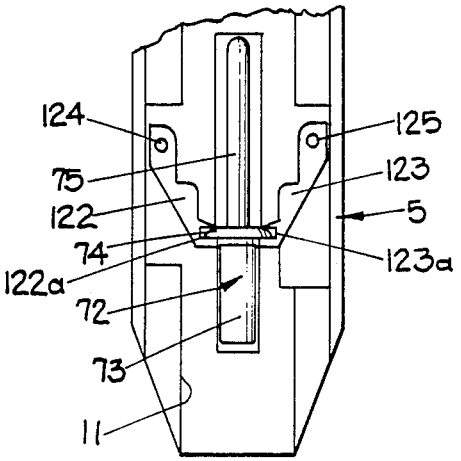
FIG. 33 is a fragmentary front elevational view of the guide body of the present invention with the front plate removed.

To complete the feed mechanism, a pair of rivet holders 122 and 123 are pivotally mounted by means of pivot pins 124 and 125 in the track 11 of guide body 5 (see FIG. 33). The rivet holders 122 and 123 are spring biased toward each other by springs (not shown) and their lowermost ends are slotted as at 122*a* and 123*a*. When the forwardmost rivet 72 of the row is advanced into the track 11 of guide body 5 by the feeder shoe—feeder pawl assembly 76–77, the head 74 of the rivet will pivot the rivet holders 122 and 123 away from each other until the head 74 is engaged in the rivet holder slots 122*a* and 123*a*. Notches in rivet holders 122 and 123 (not shown) center and hold the rivet 72 by its head 74 in the track 11. Once the rivet mandrel 75 has been received in the nose piece 33 of the rivet pickup and pull mechanism, the rivet holders 122 and 123 will be shifted out of the way by the nose of the descending load post 23.

It is within the scope of the invention to provide access ports in the guide body 5 by which, through the use of an appropriate tool, the feeder pawl 77 and ratchet 111 can be shifted to their release positions, so that a strip of rivets can be removed from the magazine 7, if desired.

The rivet pickup and pull mechanism and the rivet feed mechanism having been described in detail, the operation of the tool can now be set forth. At the beginning of a typical cycle, the lower load piston 12 and upper pull piston 38 will be at the bottom of cylinder 3. The nose piece 33 will be exposed at the bottom end of guide body 5. A rivet will be mounted in the nose piece, its mandrel portion extending through perforation 35 in the nose piece and held there frictionally by the nose piece O-ring 37.

At this stage, pressure is supplied to cylinder 3 above the upper pull piston through port 187*a*, causing both pistons to be at their lowermost positions. When the upper pull piston 38 is at its lowermost position, the jaws 51 and 52 abut the inside surface of the nose piece 33, shifting the jaws 51 and 52 upwardly against the action of spring biased plunger 57, causing the jaws to be in their open position about the mandrel of the rivet. The inside surface of each nose piece is so located that the jaws open wide enough to accommodate the mandrel diameter for which the nose piece is designed. At this point, air is introduced between the upper pull piston 38 and the lower load piston 12 through port 184*a*, and the air above the upper pull piston 38 is exhausted through port 187*a*. The air pressure introduced between the two pistons will cause the upper pull piston 38 to shift upwardly and will maintain the lower load piston 12 in its lowermost position. Upward movement of the upper pull piston 38 will shift jaws 51 and 52 out of contact with the inside surface of nose piece 33, and the jaws will engage the rivet mandrel under the urging of spring biased plunger 57. Further upward movement of upper pull piston 38 will clinch the rivet and break off its mandrel. The maximum upward movement of upper pull piston 38 is determined by the abutment of the pull sleeve flange 45 against the lower end of load sleeve 14. When the pull sleeve 41 has reached this position, its annular notch 43 will connect the ports 18 and 19 of load sleeve 14 to the air pressure between the pistons, causing some of that air pressure to be applied beneath lower load piston 12 through check valve 22 and the two pistons will begin to shift upwardly together. When the lower load piston 12 passes the port 184*a* that introduced air pressure between the two pistons, this port will apply air pressure directly under the lower load piston 12 to cause the two pistons to rise upwardly.

Figure 34:
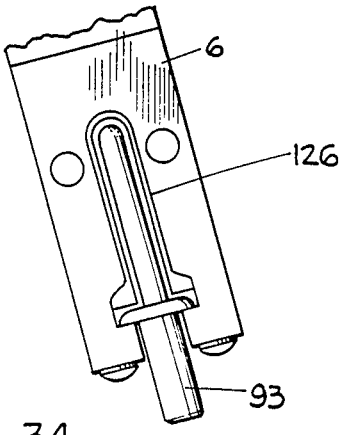
FIG. 34 is a fragmentary view of the tool bracket, at the rearward end of the magazine.

The upper pull piston 38 moves upwardly until it abuts the cap 9 of cylinder 3. At that point, the air pressure between pistons 12 and 38 is exhausted through port 235*a* and check valve 132 so that the lower load piston 12 rises until it abuts the upper pull piston 38 as shown in FIG. 2. When the upper pull piston 38 and the lower load piston 12 are in their uppermost positions as shown in FIG. 2, the rivet pickup and pull mechanism is in its fully retracted position substantially above the track 11 of the guide body 5. The last portion of the upward movement of the lower load piston 12 causes the cam surfaces 31 and 32 to actuate the feeder arm—feeder cam assembly 94–95 to shift the feeder shoe—feeder pawl assembly 76–77 forwardly, introducing the forwardmost rivet of the strip of rivets into the track 11 of guide body 5, wherein the forwardmost rivet is engaged, centered and held by rivet holders 122 and 123. At this point, air under pressure is introduced above the upper pull piston 38 through port 187*a* while the air pressure is exhausted from beneath the lower load piston 12 through port 184*a*, causing the pistons to shift downwardly together. As this occurs, the feeder arm—feeder cam assembly 94–95 is released from load post cam surfaces 31 and 32 and returned to their normal positions, being spring biased thereto by a spring (not shown). This, in turn, shifts the feeder shoe—feeder pawl assembly 76–77 to its normal retracted position, locating the forward abutment end 80 of feeder pawl 77 behind the second rivet of the strip. The first and second rivets of the strip will also be engaged by ratchet 111 to preclude rearward movement of the strip. The mandrel of the forwardmost rivet 72 in the track 11 of guide body 5 will enter the bore 35 of nose piece 33 and will be frictionally engaged therein by O-ring 37. As the pivot pickup and pull mechanism continues its downward movement, it pushes holders 122 and 123 aside so that the rivet head 74 is released. Then it breaks away the forwardmost rivet of the strip. Air under pressure which remains under lower load piston 12 after it passes over port 184*a* is bled out through port 239*a* under the piston. When the two pistons are in their lowermost positions, the rivet will extend from beneath the guide body 5 ready for placement, and the cycle will be complete. The tool may be recycled by means of the trigger until the supply of rivets is exhausted. At this time, a new strip 93 of rivets can be introduced into the magazine through an appropriately configured opening 126 formed in the bracket 6 (see FIG. 34). The strip is simply shoved manually into the magazine until the first rivet of the strip passes past feeder pawl 77 and ratchet 111.

There will, of course, be no rivet mounted in nose piece 33 ready for setting. The operator, however, need only actuate trigger 8 to cause the tool to "dry-fire". The rivet pickup and pull mechanism will shift to its retracted position, causing the forwardmost rivet to enter the track 11 of guide body 5, whereupon shifting of the rivet pickup and pull mechanism toward its extended position will cause the forwardmost rivet to be engaged in the nose piece and to be shifted downwardly to an exposed position beneath guide body 5, ready for setting.

As rivets are set and pulled, their mandrels will collect in mandrel tube 70, eventually passing into collecting vessel 69. Alternatively, a vacuum tube could be connected to mandrel tube 70, for collection of broken mandrel pieces at a remote collection point.

The sequencing controls of the tool 1 are all pneumatic, operated by the tool air supply. The sequencing controls provide full cycle-through control so that the tool, once triggered always goes through a full cycle before it stops. The next cycle cannot be started unless the trigger is released at the end of the previous cycle. The sequencing controls comprise a series of control valves, check valves and other elements located in the body 2 of the tool adjacent cyclinder 3, and interconnected through passages therein. The sequencing controls will now be described.

Figure 35:
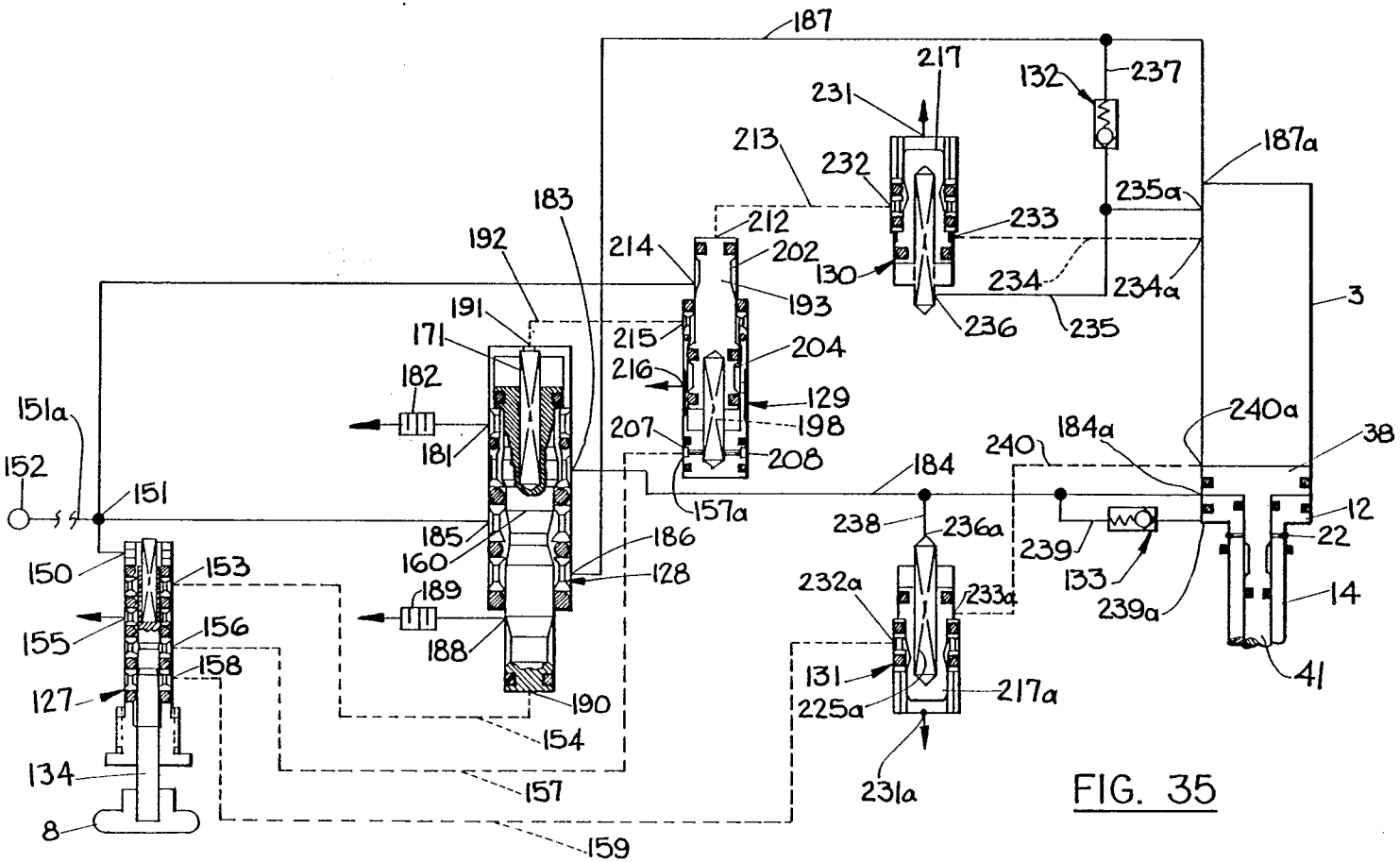
FIG. 35 is a pneumatic schematic of the tool of the present invention in its idle condition, disconnected from a source of air under pressure.

Reference is first made to FIG. 35 which is a pneumatic schematic of the tool 1 of the present invention. In FIG. 35, cylinder 3 is shown together with upper pull piston 38 and its pull sleeve 41 and lower load piston 12 and its load sleeve 14, all in their respective lowermost positions. The sequencing controls comprise a trigger valve generally indicated at 127, a main valve generally indicated at 128, a lock-up valve generally indicated at 129, position sensing valves generally indicated at 130 and 131 and a pair of check valves generally indicated at 132 and 133.

Figure 36:
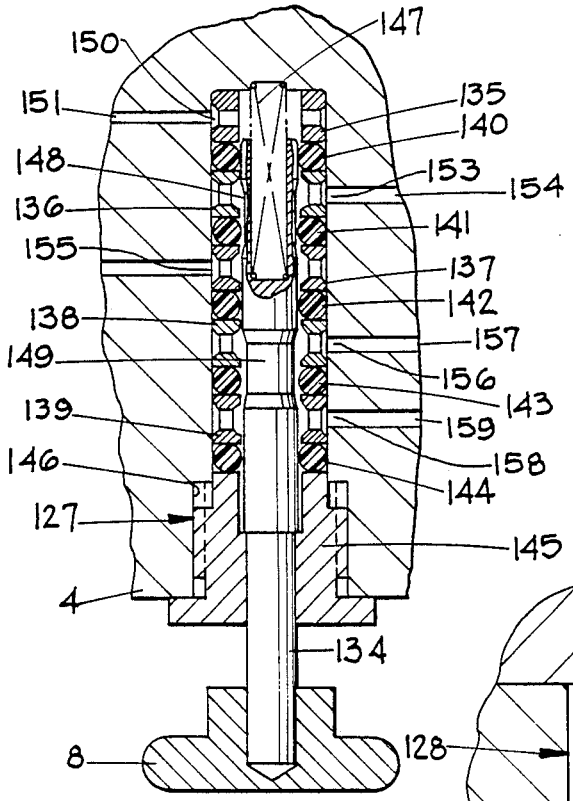
FIGS. 36, 37, 38 and 39 are simplified cross sectional illustrations of the trigger valve, the main valve, the lockup valve and the upper position sensing valve of the present invention.

Reference is made to FIG. 35 and to FIG. 36 wherein the trigger valve 127 is illustrated. The trigger valve 127 comprises a valve stem 134 which is slidingly fitted into valve cages 135–139 and O-rings 140–144. Radial openings through each cage, as shown, permit air to flow between the outside of the cage and its axial bore. Bushing 145 is threadingly engaged with the outer end of stepped bore 146 in handle portion 4 of tool body 2 to hold the trigger valve 127 in place. The upper end of stem 134 is provided with a bore for spring 147, which biases valve stem 134 downward. Valve stem 134 has two sections of reduced diameter 148 and 149, which taper into the stem diameter to slidingly engage or disengage various O-rings on their inside surfaces as stem 134 is moved up or down. Ports in valve bore 146 connect various passages to the trigger valve 127. The topmost port 150 connects trigger valve 127 to air supply manifold 151 and air supply 152. Supply pressure from port 150 acts on the upper end of stem 134 to bias the stem downward. The zone between O-rings 140 and 141 is connected to main valve 128 through port 153 and passage 154. The zone between O-rings 141 and 142 is connected through exhaust port 155 to the outside of the tool. The zone between O-rings 142 and 143 is connected to lock-up valve 129 through port 156 and passage 157. The zone between O-rings 143 and 144 is connected to lower position sensing valve 131 through port 158 and passage 159. The valve cages 135–139 and O-rings 140–144 thus divide bore 146 into various pressure zones, which are selectively connected by engagement and disengagement of the O-rings 140–144 with the stem surface as stem 134 slides past the O-rings. In the lowermost position of stem 134, reduced diameter zone 149 connects port 158 to port 156, while reduced diameter zone 148 connects port 153 to exhaust port 155. When the operator pushes trigger 8 to move stem 134 upward against the bias from spring 147 and the air pressure to its upward position, reduced diameter zone 148 connects port 153 to supply pressure port 150 while reduced diameter zone 149 exhausts pressure from port 156 through exhaust port 155. Port 158 is closed off when stem 134 is in the upward position.

Figure 37:
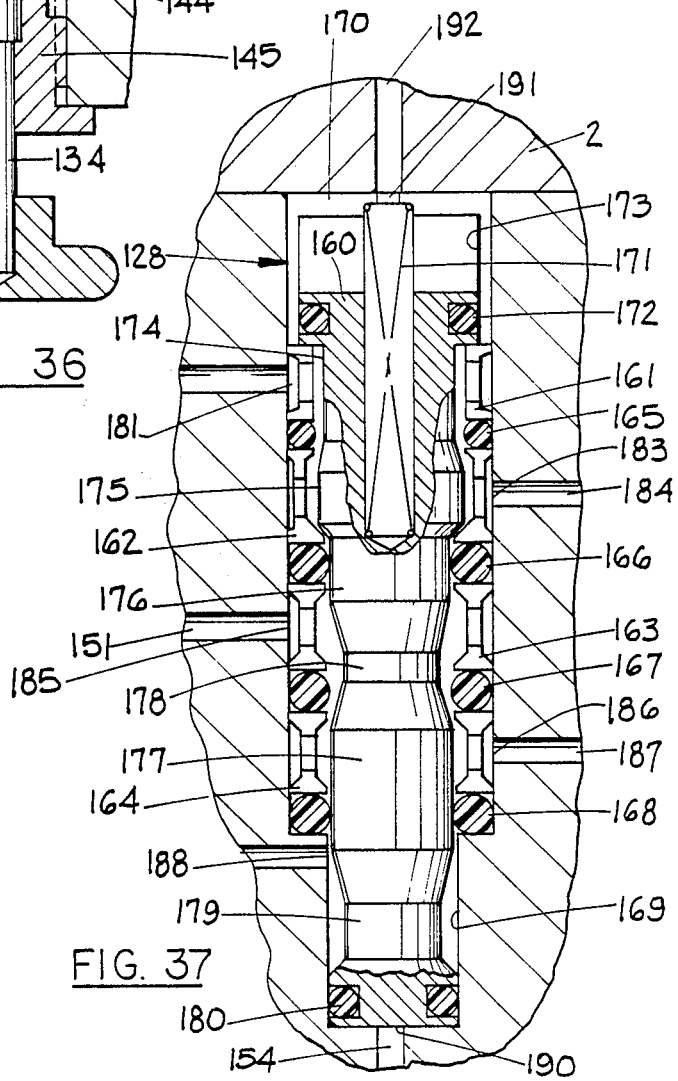

The main valve 128 is illustrated in FIG. 37. The valve assembly is comprised of a valve stem 160 which is slidingly fitted into valve cages 161–164 and O-rings 165–168, all fitted into stepped bore 169 in tool body 2. Radial openings through each cage, as shown, permit air to flow between the outside of the cage and its axial bore. The upper end of the valve is closed off by sleeve 170 which in the tool assembly abuts against a part of tool body 2. The upper end of stem 160 is provided with a bore for spring 171, which biases the valve stem downward. Valve stem 160 carries O-ring 172, which is slidingly engaged with bore 173 of sleeve 170, in a groove at its upper end. Below the groove for O-ring 172, there is a reduced diameter portion 174 on valve stem 160. Stem 160 then increases in diameter through a tapered section to land 175. Below land 175 the stem diameter is reduced to lands 176 and 177. Lands 176 and 177 taper into a section of reduced diameter 178 between them. The lower end of land 177 tapers to a reduced diameter 179 from which it expands into a section which carries O-ring 180 in a groove on its outside. O-ring 180 is slidingly engaged in a reduced diameter section of stepped bore 169, part of tool body 2. The outside diameter of O-ring 180 is the same as the diameter of valve lands 176 and 177. Valve cages 161–164 in conjunction with O-rings 165–168 divide stepped bore 169 into pressure zones. The topmost zone around sleeve 170 and cage 161 is connected through port 181 and muffler 182 to exhaust outside the tool. The next zone around cage 162 is connected by port 183 through passage or manifold 184 to cylinder 3 near its bottom end at port **184*a*. The zone around cage 163 is connected to compressed air supply manifold 151 through port 185. The zone around cage 164 is connected through port 186 and manifold 187 to the top of cylinder 3 at port 187*a*. The upper end of the reduced diameter section of bore 169 is connected through port 188 and muffler 189 to exhaust outside the tool. The bottom of bore 169 is connected to trigger valve 127 through an actuator port 190 and passage 154. In the idle position shown, reduced diameter section 174 of stem 160 connects port 183 to exhaust through port 181. At the same time reduced diameter section 178 of stem 160 connects air supply pressure from port 185 to manifold 187. Supply pressure at port 185 exerts no axial force on stem 160 as the dimeters of lands 176 and 177 are the same. When pressure is applied to actuatorport 190 at the bottom of valve 128, it moves stem 160 upward. In the upward stem position, reduced diameter section 178 of stem 160 connects port 183 to air pressure supply port 185. At the same time, reduced diameter section 179 of stem 160 connects port 186 to exhaust through port 188 and muffler 189. In this position valve stem 160 is biased upward due to the upward force created by the air pressure on the differential area between the diameter of larger land 175 and smaller land 177, both of which are sealed against their respective O-rings. This bias overcomes the downaward bias on stem 160 exerted by spring 171. The valve, once operated, remains in its operated position until either supply pressure is removed from port 185 or pressure is applied to a reset port 191 from lock-up valve 129 via passage 192 to overcome the upward bias of the pressure acting on the area differential between lands 175 and 178. Bore 173 in sleeve 170 is so sized that application of supply air pressure to it will cause stem 160 to move downward against upward biases applied by air pressure either at port 190 or resulting from the upward bias from pressure on the difference in areas between lands 175 and 176**, or both of these combined. The importance of this valve design will become apparent when control operation is explained hereinafter.

Figure 38:
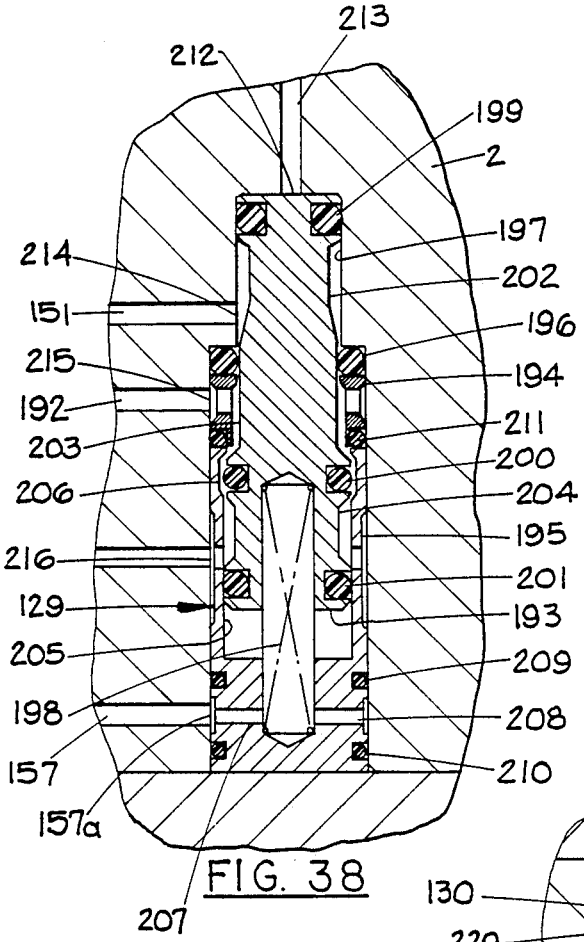

The lock-up valve 129 is illustrated in FIG. 38. The valve assembly is comprised of a valve stem 193 which is slidingly fitted into two valve cages 194 and 195 and O-ring 196, all fitted into stepped bore 197 in tool body 2. Radial openings through each cage, as shown, permit air to flow between the outside of the cage and its axial bore. The lower end of valve 129 is closed off by cage 195 which in the tool assembly abuts against a part of tool body 2. The lower end of stem 193 is provided with a bore for spring 198, which biases valve stem 193 upward. Stem 193 carries a smaller O-ring 199 at its upper end and two identically sized larger O-rings 200 and 201 at its lower end. Below O-ring 199, diameter 202 of stem 193 is reduced. The diameter of stem 193 then increases in a taper to land 203. Below land 203 a groove in a larger stem diameter houses O-ring 200. The diameter of stem 193 below O-ring 200 is reduced as at 204. At the end of the reduction a groove houses O-ring 201 at the lower end of stem 193. Bore 205 of valve cage 195 has an enlarged section 206 at its upper end. The lower end of bore 205 forms a recess for spring 198. The recess ends in cross drilled radial reset ports 207 and 208 to the outside of cage 195. O-rings 199, 209, 210, 211, and 196 divide valve bore 197 into several zones. The top of valve bore 197 is connected to upper position sensing valve 130 through an actuator port 212 and passage 213. The zone between O-rings 199 and 196 on valve stem 193 is connected to compressed air supply manifold 151 through port 214. The zone between O-rings 196 and 211, the output of valve 129, is connected to main valve 128 through port 215 and passage 192. The zone between O-rings 211 and 209 is connected to exhaust port 216. The zone between O-rings 209 and 210 is connected to trigger valve 127 through port **157*a* and passage 157. In the idle position shown with valve stem 193 up, port 215 is connected through reduced diameter section 203 of valve stem 193 and enlarged diameter section 206 of valve cage 195 to exhaust port 216. Air pressure applied to actuator port 212 biases stem 193 downward against the bias from spring 198. In the downward position of stem 193, port 215 is connected to compressed air supply port 214 through reduced diameter section 202 of valve stem 193. In this position of stem 193, a downward bias is exerted on it by the air pressure acting on the differential area formed between the diameter of bore 205 at O-ring 200 and the smaller diameter of bore 197 at O-ring 199. This downward bias is strong enough to overcome the upward bias from spring 198 so that valve stem 193 stays down. Valve stem 193 can be returned to its upward position either by disconnecting the compressed air supply from port 214 or by the application of air pressure to port 157*a* and through ports 207–208 to the underside of stem 193 and O-ring 201 inside bore 205. When pressure is supplied to reset ports 207–208, stem 193 returns to its upward position under the bias of spring 198 against the bias exerted by pressure at port 212** and the previously described differential area as the upward biased pressure area is at least equal to the downward biased area.

Figure 39:
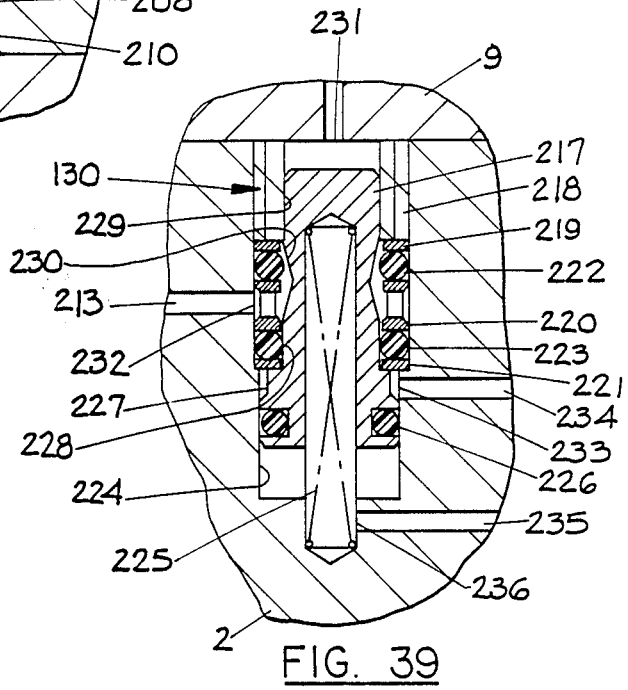

The two position sensing valves 130 and 131 are identical. The upper position sensing valve 130 is illustrated in FIG. 39. The valve assembly is comprised of valve stem 217 which fits slidingly into four valve cages 218–221 and O-rings 222 and 223, all fitted into stepped bore 224 in tool body 2. Radial openings through cage 220, as shown, permit air to flow between the outside of the cage and its axial bore. The upper end of valve 130 abuts against a flange of cap 9. The lower end of stem 217 is provided with a bore for spring 225, which biases valve stem 217 upward. Stem 217 carries O-ring 226 at its lower end. O-ring 226 fits slidingly into the reduced section of bore 224. Above O-ring 226 the diameter of stem 217 is reduced as shown at 227. The diameter of stem 217 is then further reduced to lands 228 and 229. Between lands 228 and 229 there is a double tapered circumferential groove 230. Valve bore 224 is divided into several zones by the valve cages and O-rings as shown. The top end of valve bore 224 is connected to exhaust outside the tool through port 231. The zone between O-rings 222 and 223, the output signal of valve 130, is connected to lockup valve 129 through port 232 and passage 213. The zone between O-ring 223 in valve bore 224 and O-ring 226 at the bottom end of valve stem 217 is connected to cylinder 3 through port 233, passage 234, and port **234*a*. Port 234*a* is so located in cylinder 3 that it is connected to the underside of piston 12 only when piston 12 is in its uppermost position. The lower end of bore 224 is connected through port 236 to passage or manifold 235, which is connected to cylinder 3 at port 235*a*. With both pistons 12 and 38 in their respective uppermost positions, this port is at the line between them. When valve stem 217 is in its uppermost position, held there by the bias of spring 225, groove 230 on its outside connects port 232 to exhaust port 231 through axial grooves on the inside of cage 218 and the clearance between stem 217 and cage 219. Valve 130 can shift to the operated position with the stem down, only if pressure is applied through port 233 to the downward differential area formed by the smaller diameter on the inside of O-ring 223 and the slightly larger outside diameter of O-ring 226. When the correct pressure pattern is applied to valve 130, stem 217 moves to its upward position. In this position pressure from port 233 is connected through groove 230 to output signal port 232. Any pressure applied to the large area at the bottom of the stem at the outside diameter of O-ring 226 through port 236 counteracts the downward pressure, as does the bias from spring 225. In the normal operation of fluid power cylinders, such a valve when connected as shown here, will have pressure at output port 232 only when the piston in the cylinder is at the extreme contiguous end of its stroke and the upper side of the piston is exhausted while pressure is applied to the underside of the piston through the four way valve which controls the cylinder action, in this case main valve 128**. Simply sensing the absence of pressure at the upper end of the cylinder is ambiguous as for instance the piston may be stuck at mid-stroke.

Returning to FIG. 35, which shows the tool 1 in the idle condition without any connection to supply 152 of compressed air. All valves are in the condition dictated by the bias of their springs, as shown. The supply of compressed air is shown at 152. Compressed air manifold 151 is connectable to it through port **151*a*. Compressed air manifold 151 supplies compressed air to the upper end of trigger valve 127 through port 150, the middle of main valve 128 through port 185, and near the upper end of lockup valve 129 through port 214. In the idle condition with stem 160 in the downward idle position, main valve 128 connects manifold 187 to compressed air supply manifold 151. It also connects manifold 184 to exhaust outside the tool through port 181 and muffler 182. Manifold 187 is connected to the top of cylinder 3 at port 187***a*. A branch 237 from manifold 187 goes to the outlet of check valve 132. The inlet of check valve 132 is connected to cylinder 3 through manifold 235 at port 235*a*. Port 235*a* is the thickness of piston 38 below the top of cylinder 3. A branch of manifold 235 goes to the bottom port 236 of upper position sensing valve 130. Manifold 184 is connected to cylinder 3 at port 184*a*. Port 184*a* is spaced the thickness of piston 12 above the bottom of cylinder 3. Manifold 184 has two other branches. Branch 238 is connected to the top of lower position sensing valve 131 at port 236*a*. Branch 239 contains check valve 133, the inlet of which is connected to the bottom of cylinder 3 at port 239*a*.

Trigger valve port 153 is connected to the bottom port 190 of main valve 128 by passage 154. In the idle condition passage 154 is connected to trigger valve exhaust port 155. Trigger valve port 156 is connected to the bottom port 157*a* of lock-up valve 129 by passage 157. In the idle condition passage 157 is connected by the trigger valve through port 158 to the output signal port 232*a* of lower position sensing valve 131 through passage 159.

Lockup valve 129 is connected at the top (port 212) to the output signal port 232 of upper position sensing valve 130 through passage 213. The zone of valve 129 below that, is connected to compressed air supply manifold 151 through port 214. The zone below that is connected to the upper port 191 of main valve 128 through port 215 and passage 192. In the idle condition port 215 is connected by lockup valve 129 to exhaust port 216. The bottom port 157*a* of lockup valve 129 is connected to trigger valve port 156 through passage 157.

Upper position sensing valve 130 is conneced at its bottom port 236 to manifold 235. The port 233 in the section of valve 130 above that is connected to cylinder 3 by passage 234 through cylinder port 234*a*. Port 234*a* is spaced the thickness of both pistons 38 and 12 below the top of cylinder 3. The section of valve 130 above port 233 is the output of valve 130. The output port 232 is connected to lock-up valve 129 through passage 213 and lockup valve port 212. In the idle condition pasage 213 is connected through valve 130 to its exhaust port 231.

Lower position sensing valve 131 is mounted upside down from the orientation of upper position sensing valve 130. Valve 131 is connected at the top to branch 238 of manifold 184 through ports 236*a*. The section of valve 131 below that is connected to cylinder 3 at port 240*a* by passage 240 through port 233*a*. Port 240*a* is spaced the thickness of both pistons 38 and 12 above the bottom of cylinder 3. The section of valve 131 below port 240*a* is the output of valve 131. Output port 232*a* is connected to trigger valve port 158 through passage 159. In the idle condition, passage 159 is connected through valve 131 to exhaust port 231*a*.

Upper check valve 132 is connected between manifold 235 and branch 237 of manifold 187. It permits air under pressure which would otherwise be trapped between pistons 12 and 38 to escape to manifold 187 at the end of their respective upward strokes.

Lower check valve 133 is located in branch or passage 239 between port 239*a* in cylinder 3 and manifold 184. It permits air under pressure to escape from the underside of piston 38 to manifold 184 at the end of the downward stroke of piston 38.

As indicated above, FIG. 35 may be considered to represent the sequencing controls of tool 1 in their normal, idle condition when the tool is not connected to a source of air under pressure. Under these circumstances, all the valves will be in the positions shown by virtue of their actuator springs. Pistons 12 and 38 may be in any possible position along their strokes in cylinder 3 at this time. They will be separated at least slightly due to the pressure of spring 62 on plunger 57 and through it on jaws 51 and 52, which pushes the jaws out of chuck 48 as far as they can go and against the rearward extension of nosepiece 33.

Figure 40:
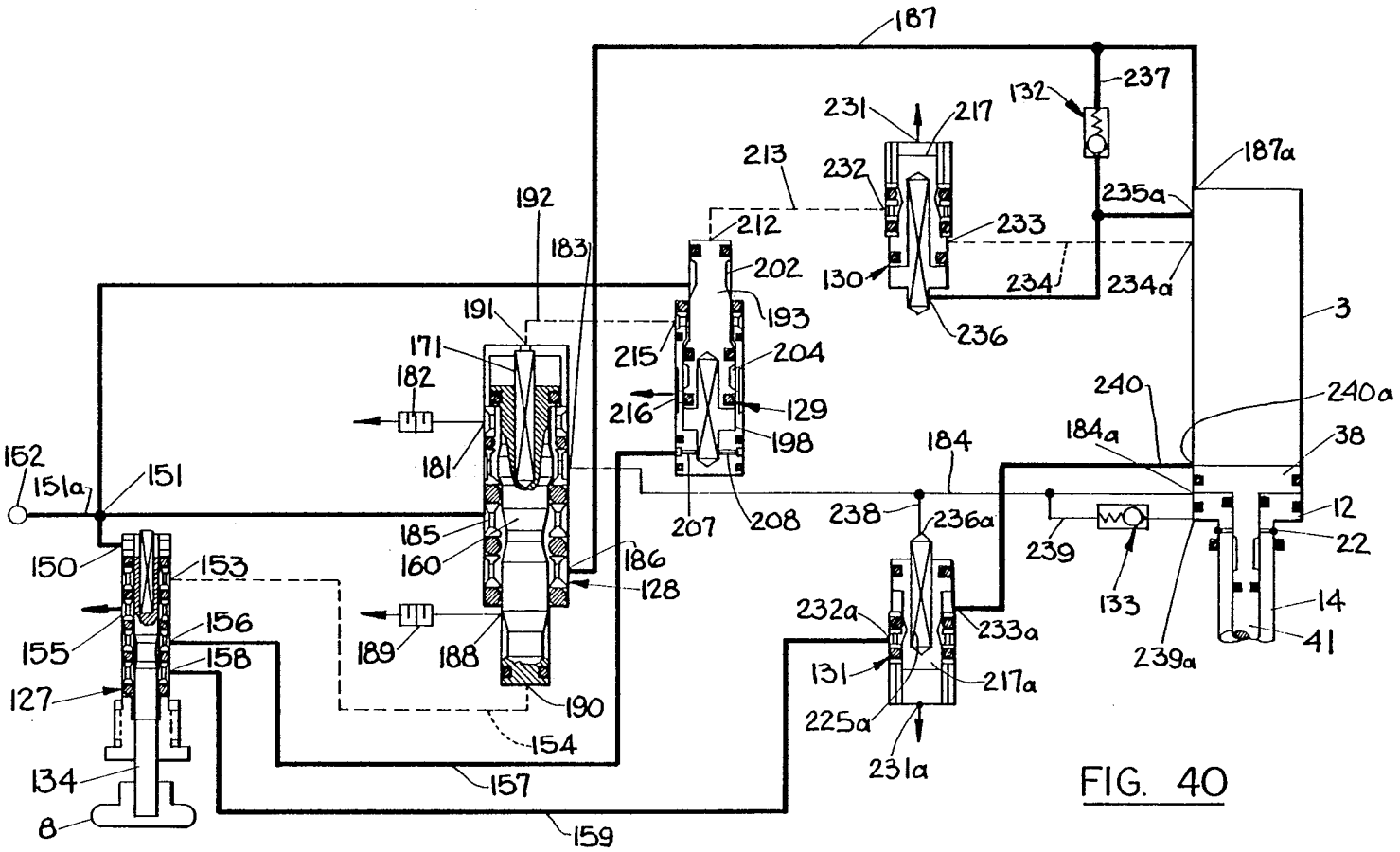
FIGS. 40 through 45 are pneumatic schematics of the tool of the present invention, illustrating the sequencing controls at various stages of a tool cycle.

FIG. 40 is similar to FIG. 35 and like parts have been given like numerals. FIG. 40 illustrates the sequencing controls when the tool is in its normal, idle position, having been connected to the source of air under pressure 152.

It will be noted from FIG. 40 that trigger valve 127, main valve 128, lockup valve 129, and position sensing valve 130 are in the same position shown in FIG. 35. Only position sensing valve 131 has shifted as will be discussed hereinafter. Air under pressure from source 152 is conducted to cylinder port 187*a* through manifold 151, main valve 128, and manifold 187. Air pressure thus applied to the top surface of piston 38 forces both pistons 12 and 38 against the bottom end of cylinder 3 as shown in FIG. 40. The under side of piston 38 is connected to exhaust through port 184*a*, manifold 184, main valve 128, port 188, and muffler 189. The underside of piston 12 is simultaneously vented through lower check valve 133 and branch 239 of manifold 184.

With respect to lower position sensing valve 131, it will be noted that pressure is supplied to the reduced section of stem 217*a* from cylinder 3 through port 240*a* while pressure is exhausted through branch 238 of manifold 184. This pressure acting on the reduced section of stem 155 overcomes the opposing bias from spring 225*a* to push stem 217*a* of valve 131 upward into the operated position. In the operated position of stem 217*a*, cylinder port 240*a* is connected through valve 131 to passage 159. Pressure from port 154 is thus applied through passage 159, trigger valve 127, and passage 157 to the underside of stem 193 of lockup valve 129. As stem 193 is already in its upward position due to the bias from spring 198, it does not move.

Figure 41:
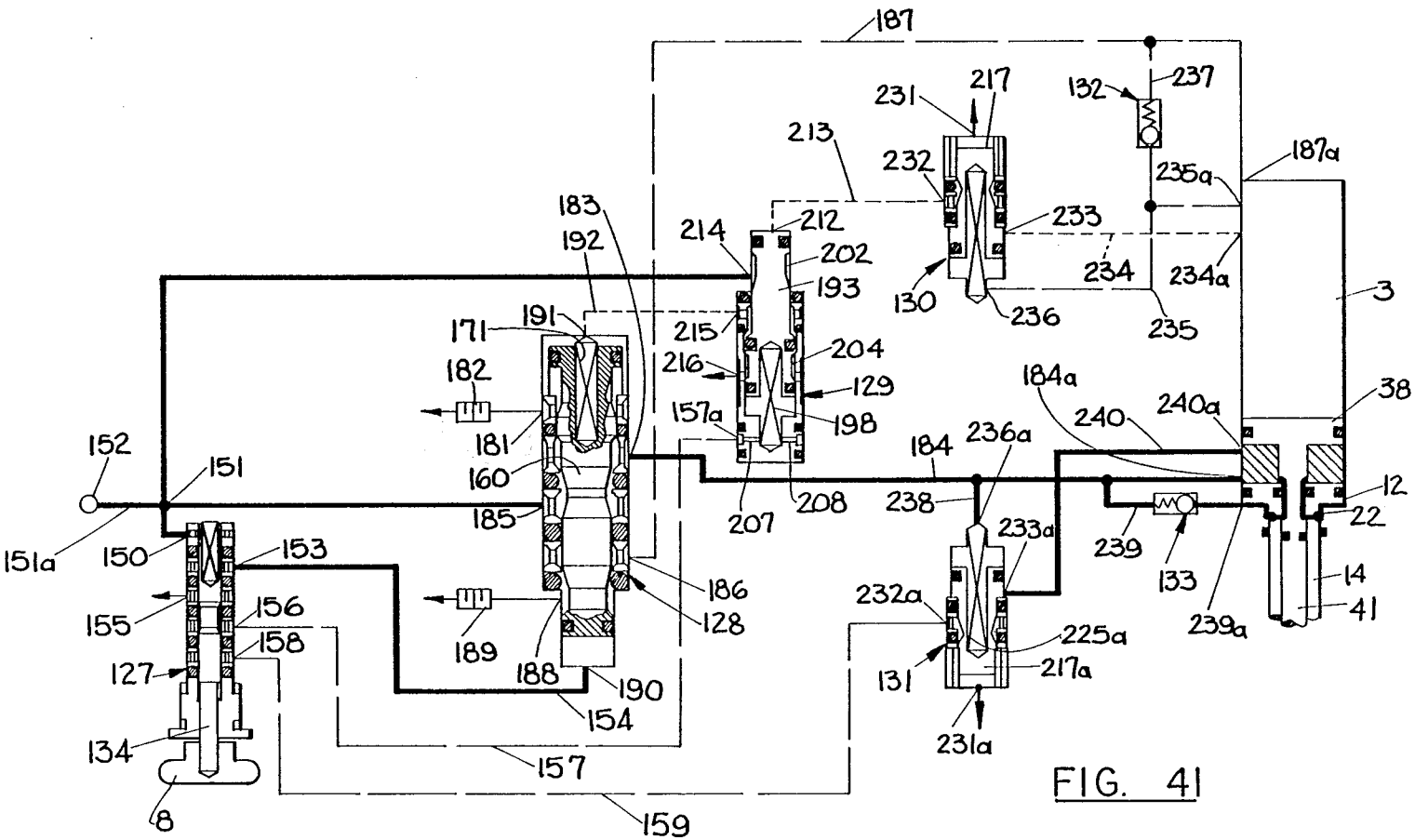

FIG. 41 illustrates the sequencing controls of the present invention after trigger 8 has been actuated. Actuation of trigger 8 pushes stem 134 of tigger valve 127 to its upward position. Passage 157 is exhausted through trigger valve 127 and port 155. Passage 154, to the lower end port 190 of main valve 128, is connected to compressed air supply manifold 151 through trigger valve 127. Application of air pressure to the lower end of main valve stem 160 pushes it upward, overcoming the downward bias of spring 171 as there is no pressure on the upper end of stem 160 from passage 192 at this time. Several things happen as a result of this change in the position of stem 160. Manifold 187 is switched from compressed air supply manifold 151 to main valve port 188. muffler 189 and through them to exhaust. Manifold 184 is switched from exhaust to compressed air supply manifold 151. As previously described for main valve 128, an upward pressure bias is created on valve stem 160, which will maintain it in this upward position regardless of whether pressure continues to be applied to the lower end of stem 160 or not. Main valve 128 thus remains operated once it is operated, regardless of the subsequent action of trigger valve 127.

Removal of air pressure from the upper end of cylinder 3 through manifold 187 removes air pressure from the connection of passage 240 of lower position sensing valve 131. Spring 225*a* then pushes stem 217*a* in valve 131 to the idle position in which pressure from passage 159 is exhausted through exhaust port 231*a* with no discernible effect at this time. Pressure from manifold 184 applied through cylinder port 184*a* between pistons 38 and 12 pushes piston 38 upward while holding piston 12 firmly against the bottom of cylinder 3, as compressed air cannot flow to the underside of piston 12 in the reverse direction of check valve 133. As was indicated earlier, this movement of piston 38 clinches a rivet and breaks off its mandrel.

When upper pull piston 38 approaches its maximum separation from lower load piston 12, notch 43 in pull sleeve 41 opens an air passage to the underside of lower load piston 12 as previously described. Lower load piston 12 then begins to shift upwardly with upper pull piston 38. When lower load piston 12 passes port 184*a*, this opens a direct supply of compressed air to the underside of lower load piston 12. Pistons 38 and 12 then rise together, retracting the pickup and pull mechanism with them.

Figure 42:
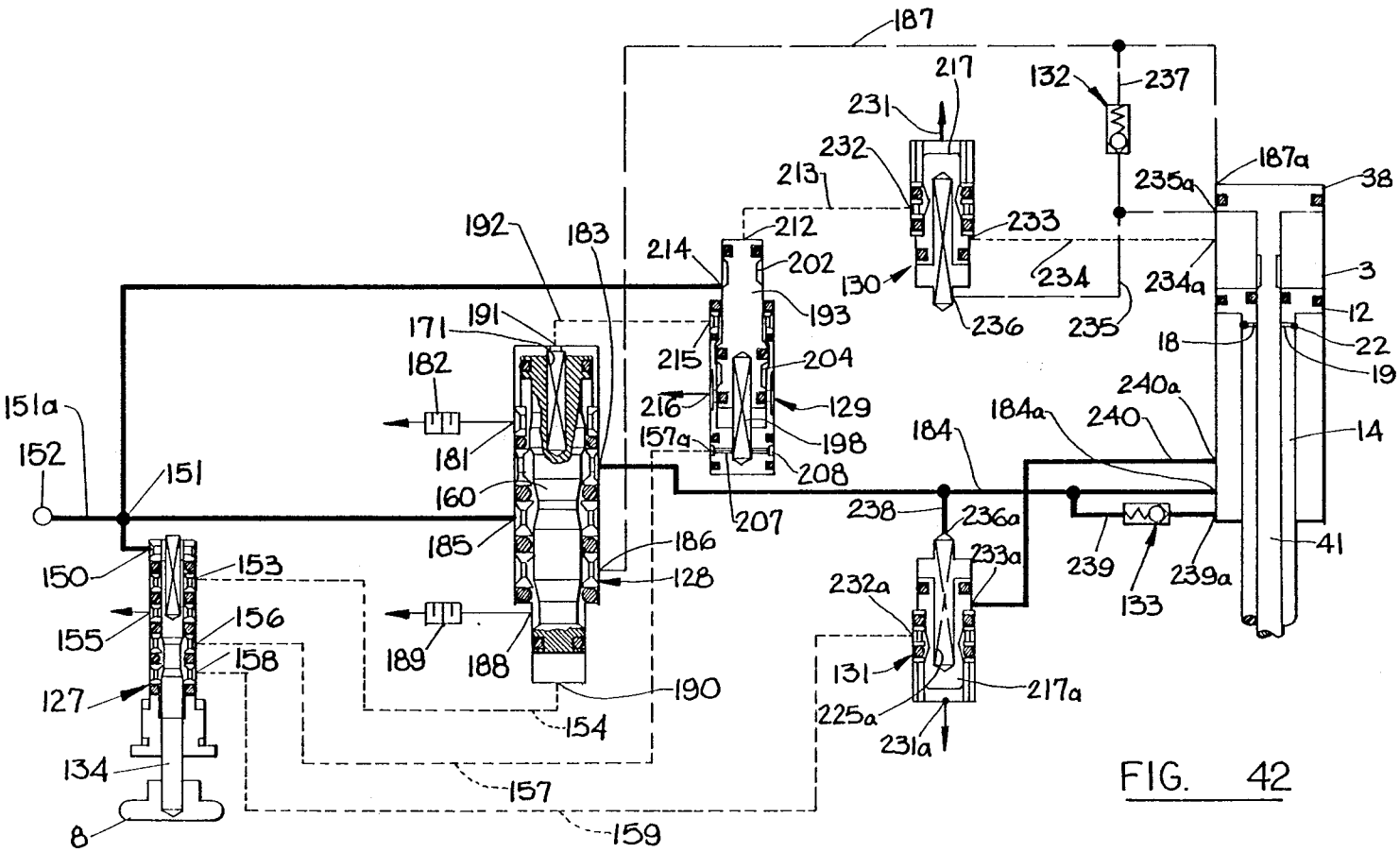

FIG. 42 illustrates the sequencing controls when upper pull piston 38 reaches the top of cylinder 3. FIG. 42 shows trigger valve 127 returned to its normal unactuated position after the operator releases trigger 8. If the operator does not release the trigger 8 so that trigger valve 127 remains in the position shown in FIG. 41, the only difference would be that passage 154 and the lower end of valve stem 160 remain pressurized.

After upper pull piston 38 reaches the top of cylinder 3, air from between pistons 38 and 12 is connected to exhaust through port 235*a*, manifold 235, upper check valve 132, branch 237, manifold 187, main valve 128, port 188, and muffler 189. As a result, the compressed air at the bottom of cylinder 3 pushes the lower piston against the upper one. At this time O-ring 22 prevents the escape of compressed air from the underside of piston 12 through ports 18 and 19 and recess 43 on the pull rod to the space between pistons 12 and 38, which is being exhausted.

Figure 43:
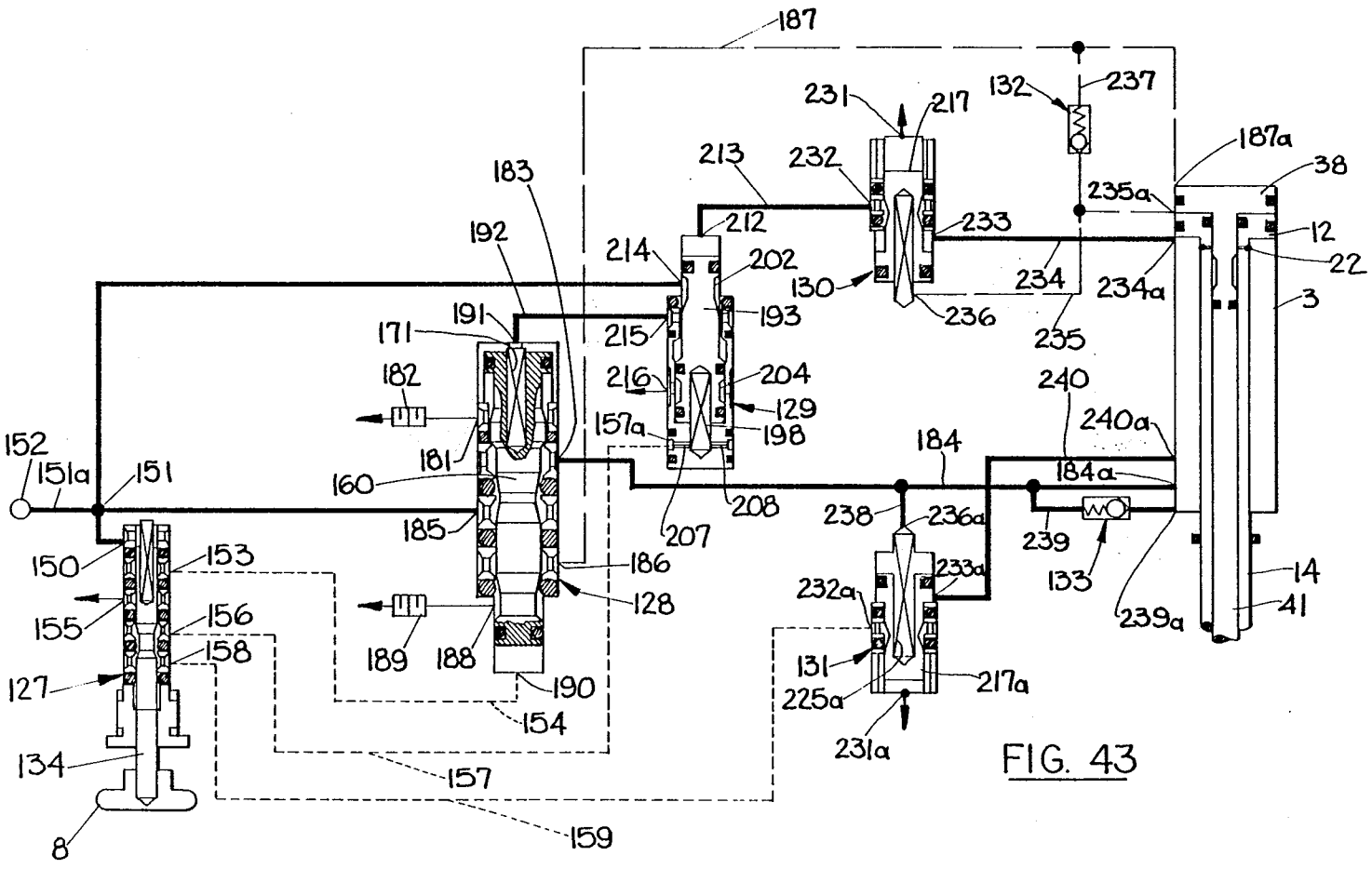
Figure 44:
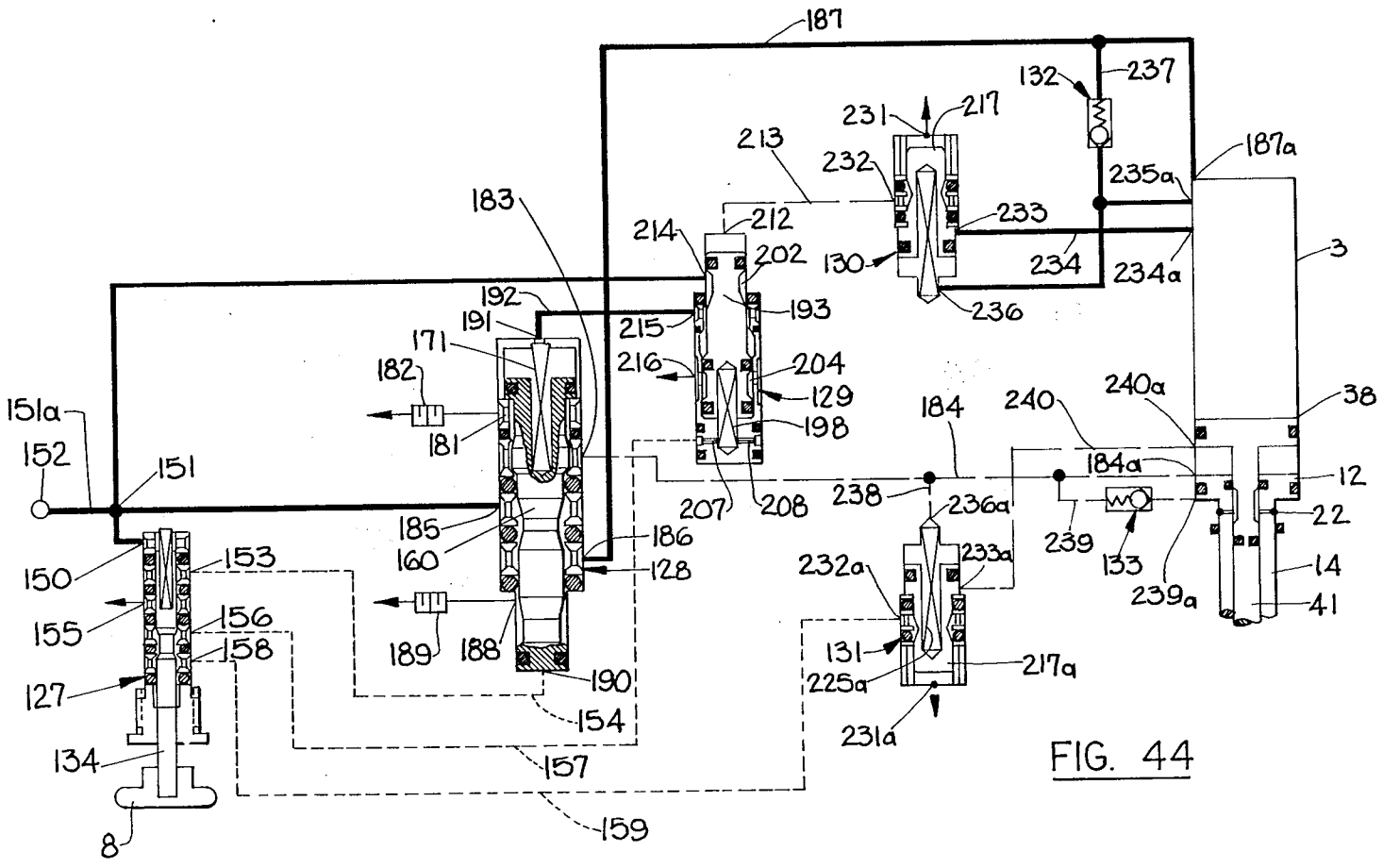

FIG. 43 illustrates the sequencing controls when the rivet pickup and pull mechanism has reached its fully retracted position. Shortly after the lower load piston 12 passes port 234*a*, upper position sensing valve 130 shifts as shown in FIG. 43 due to the application of supply pressure from cylinder 3 (via cylinder port 234*a* and passage 234) to the reduced section of stem 217, in the absence of pressure in manifold 235 at the bottom of the valve, which is connected to exhausted manifold 187 through check valve 132. Downward movement of stem 217 in sensing valve 130 connects passage 213 to pressure from cylinder port 234*a*. Pressure in passage 213 applies pressure to the upper end of lockup valve 129 via port 212. This pressure acts on the small end of stem 193, moving stem 193 downward against the upward bias of spring 198. As previously described, downward movement of stem 193 in valve 129 changes the pressure balance on stem 193 so that it stays down whether air pressure is applied to its upper smaller end or not. Also in the downward position of stem 193, passage 192 to the top port 191 of main valve 128 is connected to pressure from lock-up valve port 214. This will cause stem 160 of main valve 128 to move to its downward idle position as previously described and as shown in FIG. 44. With main valve 128 in its idle position, compressed air from manifold 151 will again be applied through main valve 128 and manifold 187 to the top of cylinder 3. The bottom of cylinder 3 will be connected to exhaust through ports 240*a* and 239*a*, manifold 184, main valve 128 and its port 181, and muffler 182.

Exhausting air pressure from under pistons 12 and 38 also exhausts air pressure at cylinder port 234*a*. Loss of this pressure to upper position sensing valve 130 causes it to return to idle. In this position of stem 217 in valve 130, air pressure is exhausted from passage 213 to the top port 212 of lock-up valve 129 without any discernible effect on valve 129. The return of upper position sensing valve 130 to its idle condition is aided by air pressure from cylinder port 235*a* as soon as upper pull position 38 passes this port and opens it to the air pressure in the top of the cylinder 3. During the extension stroke of the rivet pickup and pull mechanism, some air under pressure may cause upper pull piston 38 to separate from lower load piston 12. As the extension stroke is completed, air between the two pistons 38 and 12 is exhausted through port 184*a* to manifold 184, main valve 128 and muffler 182. Any air which might be trapped under lower load piston 12, escapes through port 239*a*, lower check valve 133, branch 239 of manifold 184, main valve 128 and muffler 182, at this time.

Figure 45:
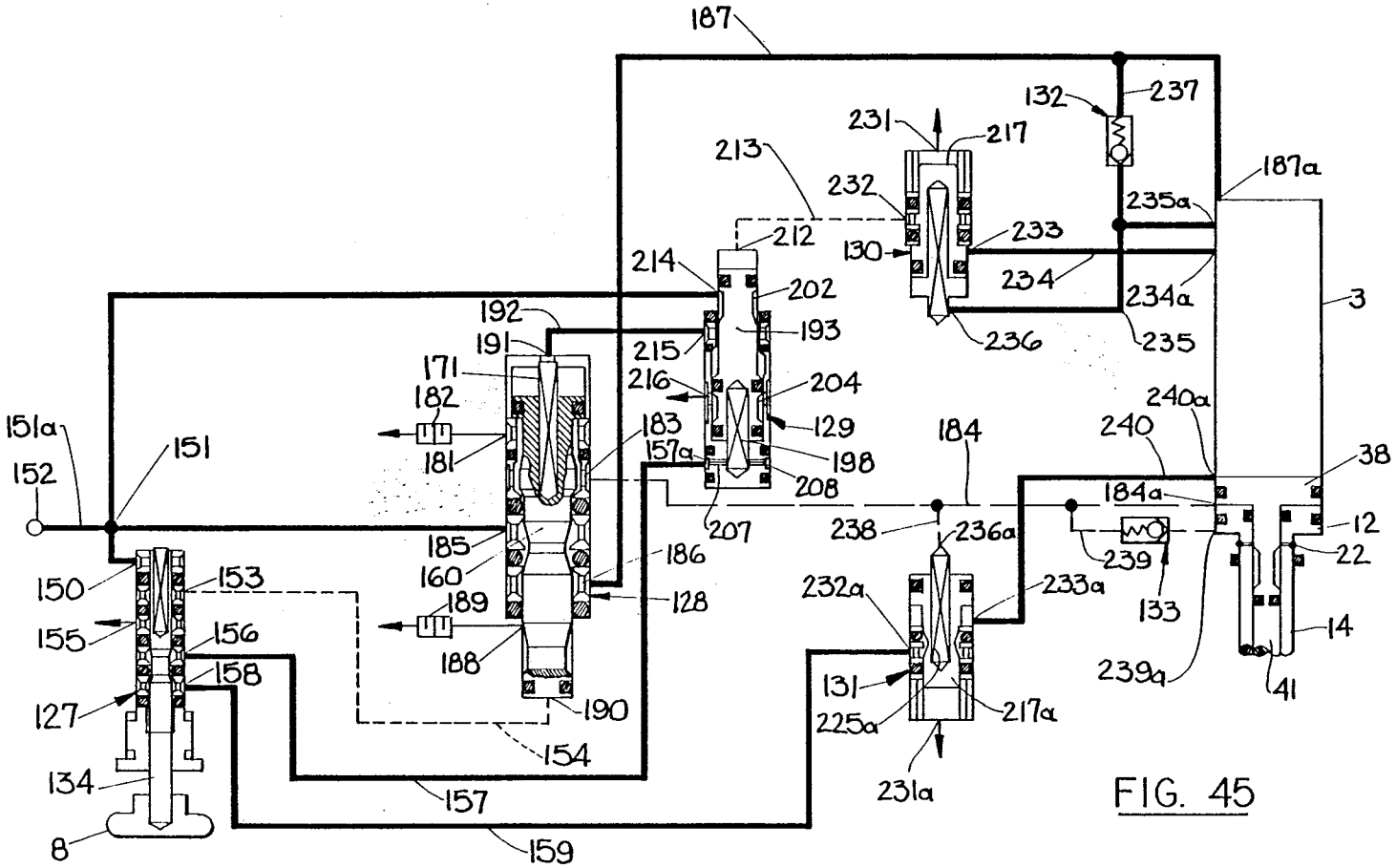

At the end of the cycle, when upper pull piston 38 reaches its lowermost position, compressed air from the top of cylinder 3 can pass through port 240*a* to lower position sensing valve 131. Branch 238 of manifold 184 is exhausted at this time so that lower position sensing valve 131 operates, in the previously described manner, as shown in FIG. 45. In the operated position, stem 217*a* of valve 131 opens a passage from port 240*a* via passage 159 to trigger valve 127. If trigger valve 127 is released at this time, or as soon as it is released, this pressure will be applied to the bottom end port 157*a* of lock-up valve 129. The lock-up valve shifts to its idle condition, restoring the sequencing controls to the idle condition shown in FIG. 40. With lock-up valve 129 shifted as described, the upper end port 191 of main valve 128 is connected to exhaust, enabling the main valve to be shifted when trigger 8 is next actuated.

The interaction of the trigger valve 127, main valve 128 and lockup valve 129 assures that the tool completes a cycle, once trigger 8 has been actuated, regardless of when the trigger 8 is released. It further assures that another cycle cannot be started unless trigger 8 is released at the end of the cycle.

Modifications may be made in the invention without departing from the spirit of it. For example, a work contacting trip could be substituted for manual trigger 8. Such a device might reduce the strain on the operator's hand in high volume production applications.

The tool 1 could be provided with a different handle configuration, one or two handles being mounted on the tool parallel to the direction of motion of the rivet pickup and pull mechanism.

The tool of the present invention is capable of setting individual rivets manually inserted in the nose piece when the tool is in its idle condition. The tool may be provided with a bulk storage magazine. While the tool has been described as being provided with a pull or pick feed mechanism, it could be provided with a push feed mechanism similar to that commonly found in pneumatic nailers and staplers.

Finally, the tool could be provided with a different work cycle such that the pickup and pull mechanism is in its retracted position in the idle condition and shifts to its extended position upon actuation of the trigger 8. The forwardmost rivet of the strip thereof would be shifted to the guide body track when the operator releases the trigger, or alternatively pulls the trigger a second time. Such an alternate work cycle would minimize the possibility of a rivet, mounted in the nose piece, being damaged while the tool is handled from workpiece-to-workpiece.

The present invention employs the unique principle of using the difference in pressure between the two sides of a piston in a double acting cylinder to signal the piston position. Thus, actuation of a position sensor can be accomplished without physical contact or an optical target, a magnet or similar device mounted on or in association with the piston rod. The position sensing valves 130 and 131 can be easily connected to the cylinder 3 through small pilot ports. Existing position sensing devices, requiring no connection to the piston rod, sense only the absence of pressure on the exhausted side of the piston. This is, as explained above, unreliable. Furthermore, the present invention uses the cylinder operating medium (in this case air) as a signal medium without any other source of energy being required.

The sequencing controls of the tool of the present invention also employ the principle that operation of a valve can change the internal pressure and area differential pattern of that valve in such a way that the valve stays in its operated condition unless disconnected from its pressure supply or operated by an overpowering means. Main valve 128 and lock-up valve 129 constitute such valves and are operated in this tool by pulses instead of continuous pressure signals. Several valves in combination are used to achieve this mode of operation. Pulse operation of valves, as taught herein, is particularly attractive for applications where such valves are operated by computers, programmable controllers and other digital devices, which put out pulses.

Words and phrases such as "top", "bottom", "upper end", "lower end", "uppermost position", "lowermost position" and the like, are employed in the specification and claims in conjunction with the drawings for purposes of clarity. It will be understood by one skilled in the art that the tool of the present invention, in use, can be held at any orientation required by that use.

What we claim is:

1. A pneumatically actuated tool for setting blind rivets of the type having a head, a body and a breakaway mandrel, said tool comprising a body having a double-acting cylinder therein having an upper end and a lower end, a handle attached to said body, a guide body affixed to said body below said cylinder lower end, a pull track in said guide body for said rivets, and a bore in said body connecting said cylinder to said pull track, said cylinder, said bore and said pull track being coaxial, a rivet pickup and pull mechanism in said tool comprising a lower load piston and an upper pull piston mounted in said cylinder, a downwardly depending first tubular assembly being affixed to said lower load piston and being slidable within said body bore and said pull track, said first tubular assembly terminating in a nose piece having an axial bore, the mandrel of a rivet mounted in said nose piece bore and means in said bore for frictionally engaging said mandrel, said first tubular assembly having a pair of diametrically opposed check valves located just below said lower load piston and an internal annular stop surface, an O-ring mounted in said body bore and sealingly engaging said first tubular assembly, a second tubular assembly affixed to said upper pull piston and telescopically and shiftably located within said first tubular assembly, said second tubular assembly having an external annular groove near its upper end, an external annular flange and an external annular notch therebetween containing an O-ring in sealing engagement with the inside surface of said first tubular assembly, said second tubular assembly terminating in a chuck, a pair of mandrel engaging jaws mounted within said chuck at said lower end thereof, said jaws being shiftable between open and closed positions and yieldable means within said chuck biasing said jaws to their closed position, said lower load piston and its tubular assembly and said upper pull piston and its tubular assembly being shiftable from a lowermost position to a separated position, to an uppermost position, and back to said lowermost position, in said lowermost position, said lower load piston being at the bottom of said cylinder with said nose piece extending externally of said guide body below said pull track and said upper pull piston being adjacent said lower load piston with said jaws engaging said nose piece and maintained in said open position thereby against the urging of said yieldable means, in said separated position said upper pull piston and said lower load piston being spaced from each other by a distance determined by abutment of said second tubular assembly flange against said first tubular assembly stop surface in said separated position of said pistons, said jaws being spaced from said nose piece and free to close about said rivet mandrel and said upper pull piston and lower load piston defining a volume of said cylinder therebetween connected to that portion of said cylinder befirst tubular assembly check valves, in said uppermost position, said upper pull piston being at the top of said cylinder and said lower load piston being adjacent said upper pull piston, said nose piece being at the juncture of said pull track and said body bore and in engagement with said jaws maintaining said jaws in said open position, a source of air under pressure and cycle-through pneumatic sequencing control means within said body and said handle connected to said air source and said cylinder for shifting said lower load piston and its first tubular assembly and said upper pull piston and its second tubular assembly from said lowermost position wherein said rivet can be placed in perforations in workpieces to be joined, to said separated position wherein said rivet is set and its mandrel severed therefrom, to said uppermost position and back to said lowermost position with the mandrel of the next rivet engaged in said nose piece.

2. The tool claimed in claim 1 wherein said first tubular assembly of said lower load piston comprises a load sleeve and a load post each having upper and lower ends, said load sleeve upper end being affixed to said lower load piston, said lower end of said load sleeve being affixed to said upper end of said load post, said nose piece being affixed to said lower end of said load post, said load sleeve having said pair of diametrically opposed check valves located therein just beneath said lower load piston, said lower end of said load sleeve providing said internal annular stop surface, said second tubular assembly of said upper pull piston comprising a pull sleeve and said chuck each having upper and lower ends, said upper end of said pull sleeve being affixed to said upper pull piston, said lower end of said pull sleeve being affixed to said upper end of said chuck, said pull sleeve having said annular groove spaced downwardly from its upper end, said annular flange at its lower end, and said notch containing said O-ring in sealing engagement with the inside surface of said first tubular assembly.

3. The tool claimed in claim 1 including a magazine, said magazine having a rearward end supported by a bracket depending from said handle, said magazine having a forward end affixed to said guide body and communicating with said pull track therein, a strip of rivets joined one behind the other and including at least first, second and third rivets, slidably mounted in said magazine, each rivet of said strip when in said pull track being severable from said strip by said nose piece when said rivet pickup and pull mechanism is shifted from said uppermost position to said lowermost position, and feed means for locating the forwardmost rivet of said strip in said pull track when said rivet pickup and pull mechanism is in said uppermost position.

4. The tool claimed in claim 1 wherein said means in said nose piece bore for frictionally engaging said rivet mandrel comprises an O-ring mounted in an annular notch formed in said nose piece bore.

5. The tool claimed in claim 1 including a plurality of nosepieces sized to accommodate rivets of different sizes and the same head diameter.

6. The tool claimed in claim 1 wherein said tool includes means to collect broken mandrels from said rivets.

7. The tool claimed in claim 1 wherein said cycle-through pneumatic sequencing control means comprises a main valve means for connecting said source of air under pressure to the top of said cylinder to shift said upper pull piston and said lower load piston to their lowermost positions and for connecting the bottom of said cylinder to exhaust through a first check valve and the portion of said cylinder between said upper pull piston and said lower load piston when in their lowermost positions to exhaust when said main valve means is in an unactuated condition and for connecting said air under pressure to said portion of said cylinder between said upper pull piston and said lower load piston when in their lowermost positions to separate said pistons setting a rivet and breaking the mandrel thereof and thereafter to shift said pistons to their uppermost positions and for connecting the top of said cylinder to exhaust and that part of said cylinder between said upper pull piston and said lower load piston when in their uppermost positions to exhaust through a second check valve when said main valve means is in an actuated condition, trigger valve means for connecting said source of air under pressure to said main valve means, said main valve means to shift from said unactuated condition to said actuated condition when said trigger valve is in an actuated condition, a lockup valve means for connecting said main valve means to said source of air under pressure to shift said main valve means from an actuated to an unactuated condition when said lockup valve is in an actuated condition, a first position sensing valve means for connecting air under pressure from said cylinder to said lockup valve means to shift said lockup valve means from an unactuated to an actuated condition when said upper pull piston and said lower load piston are in their uppermost positions and a second position sensing valve means for connecting air under pressure from said cylinder to said lockup valve means through said trigger valve when in an unactuated condition for assuring that said lockup valve is in an unactuated condition when said upper pull piston and lower load piston are in their lowermost positions.

8. The tool claimed in claim 1 wherein said cycle-through pneumatic sequencing control means comprises a trigger valve, a main valve, a lock-up valve, first and second position sensing valves and first and second check valves, each of said trigger valve, main valve, lock-up valve and position sensing valves having a stem shiftable between an unactuated and an actuated positioned and spring means biasing said stem to said unactuated position, each of said trigger valve, main valve and lock-up valve having a first port connected by a passage to said source of air under pressure, a first manifold extending from a second port in said main valve to a first port in the top of said cylinder, a second manifold extending from a third port in said main valve means to a second port in said cylinder located at a position between said upper pull piston and said lower load piston when said pistons are in their lowermost positions, said main valve having fourth and fifth ports leading to exhaust, a sixth actuating port and a seventh reset port, said first check valve being in a line connected between said second manifold and a third port at the bottom of said cylinder and being configured to permit passage of air from said cylinder to said second manifold, said second check valve being in a line connected between said first manifold and a fourth port in said cylinder located at a point between said upper pull piston and said lower load piston when in their uppermost positions and being configured to permit the passage of air from said cylinder to said first manifold, said trigger valve having a second port connected by a passage to said sixth actuating port of said main valve, a third port connected to exhaust, a fourth port and a fifth port, said lockup valve having a second port connected by a passage to said seventh reset port of said main valve, a third port connected to exhaust, a fourth reset port and a fifth actuating port, said fourth port of said trigger valve being connected by a passage to said fourth reset port of said lockup valve, said first position sensing valve having a first port connected to said fifth actuating port of said lockup valve, a second port connected to exhaust, a third port connected by a passage to a port in said cylinder just beneath said lower load piston when in said uppermost position, and a fourth port connected to said fourth cylinder port, said second position sensing valve having a first port connected to said fifth port of said trigger valve, a second port connected to exhaust, a third port connected to a fifth port in said cylinder located just above said upper pull piston when in said lowermost position and a fourth port connected to said second manifold.

9. The tool claimed in claim 1 wherein said cycle through pneumatic control means comprises a main valve means having an unactuated condition for introducing air from said source into the top of said cylinder for shifting said upper pull piston and lower load piston to their lowermost position and for connecting that portion of said cylinder between said pistons in their lowermost position and the bottom of said cylinder to exhaust, said main valve means having an actuated condition for introducing air into said cylinder at a position between said pistons when in their lowermost position to shift said upper pull piston to said separated position to set a rivet and break off the mandrel thereof and for thereafter shifting said pistons to their uppermost position and for connecting that portion of said cylinder between said pistons when in their uppermost position and the top of said cylinder to exhaust, trigger valve means having an actuated condition for connecting air from said source to an actuator port of said main valve means to shift said main valve means to its actuated condition, and an unactuated condition for connecting said main valve means actuator port to exhaust, a lockup valve means having an actuated condition for connecting air from said source to a reset port of said main valve means to shift said main valve means to its unactuated condition, and an unactuated condition for connecting said main valve means reset port to exhaust, a first position sensing valve means having an actuated condition when said pistons are in their uppermost position to connect air under pressure from said cylinder to an actuator port of said lockup valve means to shift said lockup valve means to said actuated condition, and an unactuated condition when said pistons are positioned in said cylinder other than in their uppermost position for connecting said actuator port of said lockup valve means to exhaust, and a second position sensing valve means having an actuated condition when said pistons are in their lowermost position for connecting air under pressure from said cylinder to a reset port of said lockup valve means through a line to said trigger valve means, said trigger valve means itself when in its unactuated condition, and a line from said trigger valve means to said lockup valve means reset port, for shifting said lockup valve means to said unactuated condition, and an unactuated condition when said pistons are positioned in said cylinder other than in their lowermost position for connecting said line to said trigger valve means to exhaust, said trigger valve means when in said actuated condition connecting said lockup valve means reset port to exhaust, means within said main valve means for maintaining said main valve means in said actuated condition even in the absence of air under pressure at said main valve means actuator port until air under pressure is present at said main valve means reset port, and means within said lockup valve means for maintaining said lockup valve means in said actuated condition even in the absence of air under pressure at said lockup valve means actuator port until air under pressure is present at said lockup valve means reset port, whereby said pneumatic control means is a cycle-through means requiring shifting of said trigger valve means to its unactuated condition before the start of the next cycle.

10. The tool claimed in claim 2 wherein said resilient means for urging said jaws to said closed position comprises a tubular plunger having a head at its lowermost end in contact with said jaws, said plunger being shiftably mounted in said chuck, a compression spring surrounding said plunger, the upper end of said compression spring abutting the lower end of said pull sleeve and the lower end of said compression spring abutting said plunger head urging said plunger against said jaws and said jaws to said closed position.

11. The tool claimed in claim 3 wherein said rivet feed means comprises a feeder shoe within said guide body and shiftable therein between a normal position spaced from said pull track and an actuated position adjacent said pull track, a feeder pawl pivotally mounted on said feeder shoe, said feeder pawl having an abutment surface and being spring biased to a position wherein its abutment surface engages the head of said second rivet of said strip when said feeder shoe is in said normal position, a feeder arm and cam assembly pivotally mounted in said guide body above said feeder shoe, said feeder arm and cam assembly having a downwardly depending arm means operatively connected to said feeder shoe for shifting said feeder shoe between said normal and actuated positions, means biasing said feeder arm and cam assembly for normally maintaining said feeder shoe in said normal position, a cam surface means on said first tubular assembly for cooperating with said feeder arm and cam assembly after setting of said first rivet to cause it to shift said feeder shoe to said actuated position and said second rivet into said pull track as said pickup and pull mechanism is shifted to said uppermost position and for releasing said feeder arm and cam assembly as said pickup and pull mechanism returns to its lowermost position shifting said feeder shoe to its normal position and said pawl into abutment with the head of said third rivet of said strip.

12. The tool claimed in claim 11 wherein said rivet feed means includes a ratchet pivotally mounted in said guide body said ratchet having first and second teeth, spring means biasing said ratchet to a normal position wherein said first and second teeth engage said first and second rivets of said strip preventing said strip from shifting away from said guide body, said ratchet being shiftable to a release position by said strip as said strip advances toward said guide body.

13. The tool claimed in claim 6 wherein said mandrel collection means comprises a mandrel tube mounted at the upper end of said cylinder and being coaxial therewith and telescopically received within the upper portion of said tubular assembly of said upper pull piston, a collection means for receiving broken mandrels affixed to the exterior of said tool at the upper end of said cylinder and means for connecting said mandrel tube to said collection means.

14. The tool claimed in claim 11 wherein said rivet feed means includes a pair of rivet holders pivotally mounted in said pull track, spring means for biasing said rivet holders toward each other to a position wherein they engage the head of the forwardmost rivet of said strip and hold and center said forwardmost rivet in said pull track, said rivet holders being shiftable to a release position by said nose piece upon engagement of the mandrel of said forwardmost rivet in said nose piece as said pickup and pull mechanism is shifted from said uppermost position to said lowermost position.

15. A double acting pneumatic cylinder of the type having first and second ends, at least one piston therein, a first port at the first end of said cylinder, a second port at the second end of said cylinder, and piston actuating means for simultaneously connecting said first port to a source of air under pressure and said second port to exhaust to shift said at least one piston to said second cylinder end and for simultaneously connecting said first port to exhaust and said second port to said source of air under pressure to shift said at least one piston to said first end of said cylinder, and a position sensing valve providing a pneumatic output signal when said at least one piston is adjacent said first cylinder end, said valve comprising a valve body and a valve stem, an exhaust port at one end of said valve body connected to exhaust, an inlet port at the other end of said valve body connected to a port at said first end of said cylinder, a sensing port in said valve body connected to a port in said cylinder spaced from said cylinder first end by the thickness of said at least one piston, and a signal port in said valve body, said stem being shiftable within said valve body between an unactuated position and an actuated position, spring means biasing said stem to said unactuated position, said stem having an annular notch connecting said valve body signal port to said valve body exhaust port when said stem is in said unactuated position and connecting said valve body sensing port to said valve body signal port when said stem is in said actuated position, when said piston actuating means connects said first cylinder port to said source of air under pressure and said second cylinder port to exhaust shifting said at least one piston to said second cylinder end, said position sensing valve inlet port is connected to said air under pressure at said cylinder top maintaining said valve stem in conjunction with said spring means in said unactuated position connecting said valve body signal port to said valve body exhaust port, when said piston actuating means connects said second cylinder port to said source of air under pressure and said first cylinder port to exhaust shifting said at least one piston to said first cylinder end, said position sensing valve body inlet port is connected to exhaust at said first end of said cylinder and said valve body sensing port is subject to air under pressure from said source via said second piston port shifting said valve stem against the urging of said spring means to said actuated position connecting said valve body sensing and signal ports, thus providing air under pressure at said signal port constituting said pneumatic output signal.

16. The cylinder-piston and position sensing valve assembly claimed in claim 15 including a second position sensing valve providing a pneumatic output signal when said at least one piston is adjacent said second cylinder end, said second position sensing valve comprising a second valve body and a second valve stem, an exhaust port at one end of said second valve body connected to exhaust, an inlet port at the other end of said second valve body connected to a port at said second end of said cylinder, a sensing port in said second valve body connected to a port in said cylinder spaced from said cylinder second end by the thickness of said at least one piston, and a signal port in said second valve body, said second stem being shiftable within said second valve body between an unactuated position and an actuated position, second spring means biasing said second stem to said unactuated position, said second stem having an annular notch connecting said second valve body signal port to said second valve body exhaust port when said second stem is in said unactuated position and connecting said second valve body sensing port to said second valve body signal port when said second stem is in said actuated position, when said piston actuating means connects said second cylinder port to said source of air under pressure and said first cylinder port to exhaust shifting said at least one piston to said first cylinder end, said second position sensing valve body inlet port is connected to said air under pressure at said cylinder bottom maintaining said second valve stem in conjunction with said second spring means in said unactuated position connecting said second valve body signal port to said second valve body exhaust port, when said piston actuating means connects said first cylinder port to said source of air under pressure and said second cylinder port to exhaust shifting said at least one piston to said second cylinder end, said second position sensing valve body inlet port is connected to exhaust at said second end of said cylinder and said second valve body sensing port is subject to air under pressure from said source via said first piston port shifting said second valve stem against the urging of said second spring means to said actuated position connecting said second valve body sensing and signal ports thus, providing air under pressure at said second valve body signal port constituting said pneumatic output signal of said second position sensing valve.

17. The cylinder-piston and position sensing valve assembly claimed in claim 16 including two pistons within said cylinder, said first mentioned position sensing valve providing a pneumatic output signal when both of said pistons are at said first end of said cylinder and said second position sensing valve providing a pneumatic output signal when both of said pistons are at said second end of said cylinder, said pistons being separable by up to a predetermined distance while being shifted between said first and second cylinder ends, a port means in said cylinder positioned between said pistons when both are located at said first end of said cylinder for exhausting the space therebetween, said inlet port of said first mentioned position sensing valve body being connected to said last mentioned port means, said cylinder port connected to said sensing port of said first mentioned position sensing valve body being spaced from said first cylinder end by a distance equal to the thickness of both of said pistons, said cylinder port connected to said sensing port of said second position sensing valve body being spaced from said second cylinder end by a distance equal to the thickness of both pistons, said second port of said cylinder being located at a position between said pistons when both pistons are at said second cylinder end and further being operatively connected to said second end of said cylinder through a check valved passage in said piston nearest said second cylinder end when said pistons are separated from each other by said predetermined distance, and port means at said second end of said cylinder for exhausting said second cylinder end when both pistons are at said second cylinder end.

* * * * *